US011776705B1

(12) United States Patent
Sampathkumaran et al.

(10) Patent No.: US 11,776,705 B1
(45) Date of Patent: Oct. 3, 2023

(54) HIGH TEMPERATURE AND HIGH BEAM CURRENT COMPATIBLE TARGETS AND METHODS THEREOF FOR GENERATING NOBLE GAS/RADIOHALOGEN GENERATORS FOR MEDICAL ISOTOPES

(71) Applicant: INNOSENSE LLC, Torrance, CA (US)

(72) Inventors: Uma Sampathkumaran, Torrance, CA (US); Raymond Winter, Riverside, CA (US); Harini Madakashira, Allen, TX (US)

(73) Assignee: INNOSENSE LLC, Torrance, CA (US)

( * ) Notice: Subject to any disclaimer, the term of this patent is extended or adjusted under 35 U.S.C. 154(b) by 122 days.

(21) Appl. No.: 17/151,147

(22) Filed: Jan. 16, 2021

Related U.S. Application Data

(60) Provisional application No. 62/962,145, filed on Jan. 16, 2020.

(51) Int. Cl.
*G21G 1/10* (2006.01)
*G21G 1/00* (2006.01)

(52) U.S. Cl.
CPC ..... *G21G 1/10* (2013.01); *G21G 1/001* (2013.01); *G21G 2001/0094* (2013.01)

(58) Field of Classification Search
CPC ..... G21G 1/10; G21G 1/0005; G21G 1/001; G21G 2001/0057; G21G 2001/0094; G21G 4/08; A61K 51/1206; H05H 6/00
See application file for complete search history.

(56) References Cited

U.S. PATENT DOCUMENTS 4,088,532 A * 5/1978 Blue ..... G21G 1/10 376/198
4,364,898 A * 12/1982 Meyer ..... G21K 5/08
2016/0053345 A1* 2/2016 Wilbur ..... C22B 61/00 423/249
2018/0215680 A1* 8/2018 Lindegren ..... G21G 1/001
(Continued)

OTHER PUBLICATIONS

Nolen, Jerry, et al. "Development of 211At production via continuous extraction of 211Rn." Journal of Medical Imaging and Radiation Sciences 50.1 (2019): S35-S36. (Year: 2019).*
(Continued)

*Primary Examiner* — Sharon M Davis
(74) *Attorney, Agent, or Firm* — M.J. Ram and Associates

(57) ABSTRACT

A method of providing alpha particle emitters and materials suitable for use in generating the alpha particles for medical treatment is disclosed. Metal oxide targets, preferentially $Bi_2O_3$ pellets and $Bi_2O_3$ coatings on metallic or metal oxide substrates are formed. The targets placed in a heated vacuum chamber subjecting to irradiation using a $^{6}Li$ beam at an elevated temperature below the melting point of the target generate a radioactive gas, such as $^{211}Rn$, the radioactive gas is carried by an inert gas which is delivered a carrier for, such as a carbon column or oil for delivery to a treatment facility. The radioactive gas such as $^{211}Rn$ generates $^{211}At$, which has a useable half-life of at least about 14 hours, in turn releases alpha particles which are effective for use in medical procedures.

13 Claims, 25 Drawing Sheets

(56) References Cited

U.S. PATENT DOCUMENTS

2018/0308599 A1* 10/2018 O'Hara ..... B01D 15/20
2020/0321138 A1* 10/2020 Ishioka ..... G21K 5/08

OTHER PUBLICATIONS

Nayak, Dalia, and Susanta Lahiri. "Extraction separation of No-carrier-added astatine from bismuth target." Radiochimica Acta 91.3 (2003): 159-162. (Year: 2003).*

Mandal, Swadesh, Ajoy Mandal, and Susanta Lahiri. "Separation of nca 123,124,125,126 I from alpha particle induced the natural antimony trioxide target." Journal of Radioanalytical and Nuclear Chemistry 292.2 (2012): 579-584. (Year: 2012).*

Mustapha, B., et al. "The ATLAS multi-user upgrade and potential applications." Journal of Instrumentation 12.12 (2017): T12002. (Year: 2017).*

Department of Energy. NSACI Final Report. URL: http://science.energy.gov/~/media/np/nsac/pdf/docs/nsaci_final_report_charge1.pdf. Last accessed Dec. 2019.

Nuclear Science Advisory Committee Isotopes (NSACI), Jul. 20, 2015, Meeting Isotope Needs and Capturing Opportunities for the Future: the 2015 Long Range Plan for the DOE-NP Isotope Program, Isotopes Report, p. 160. http://science.energy.gov/~/media/np/nsac/pdf/docs/2015/2015_NSACI_Report_to_NSAC_Final.pdf.

Zalutsky MR and Pruszynski M, "Astatine-211: Production and Availability", *Current Radiopharmaceuticals*, 2011, 4:177-185.

Greene JP, Nolen JA, Baker S. "Nickel-Backed Bi Targets for the Production of 211At," *Journal of Radioanalytical and Nuclear Chemistry*, 2015, 305(3):943-946.

Nolen J et al. 8th International Symposium on Targeted Alpha Therapy, Jun. 4-6, 2013 ORNL, USA.

Levin E M, Roth R S. "Polymorphism of bismuth sesquioxide. I. Pure $Bi_2O_3$," *Journal of Research of the National Bureau of Standards A. Physics and Chemistry*, 1964, 68A.

Zalutsky MR. "Production of Astatine-211 at the Duke University Medical Center for its Regional Distribution." Final Technical Report DOE-Duke-8775-1, Jan. 2015.

Jabeen Fatima M.J. et al., "Improved carrier mobility and bandgap tuning of zinc doped bismuth oxide", https://www.researchgate.net/publication/269287084_Improved_carrier_mobility_and_bandgap_tuning_of_zinc_doped_bismuth_oxide. Accessed Dec. 2019.

* cited by examiner

HIGH TEMPERATURE AND HIGH BEAM CURRENT COMPATIBLE TARGETS AND METHODS THEREOF FOR GENERATING NOBLE GAS/RADIOHALOGEN GENERATORS FOR MEDICAL ISOTOPES

This application claims priority based on U.S. Application No. 62/962,145, filed Jan. 16, 2020, which is incorporated herein in its entirety.

This invention was made with government support under Grant(s): DE-SC0007572 and DE-SC0019587, Office of Science, Department of Energy, Chicago, Ill., The US Government may have certain rights in the inventions described herein.

BACKGROUND

Alpha emitters have been identified for targeted alpha therapy (TAT) as a critical need as they deposit high ionizing radiation within a short distance (few tumor cells) while minimizing collateral damage to surrounding healthy tissue. Astatine-211 ($^{211}$At) is an alpha emitter with a 7.2 h half-life. Due to this short half-life use of Astatine-211 is limited to three regional production centers and users in their immediate vicinity. Described herein is the development of a refractory bismuth oxide ($Bi_2O_3$) target, (Gentope-At™), which is irradiated with a Lithium-6 ($^6$Li) or Lithium-7 ($^7$Li) beam as a method of production of Radon-211 ($^{211}$Rn, half-life=14 h), which then serves as a generator for $^{211}$At. This production method provides an on-demand route for continuous extraction of the noble gas generator $^{211}$Rn/$^{211}$At for overnight delivery to user facilities within the United States, enabling wider access to TAT.

Astatine-211 ($^{211}$At), was specifically identified as one among several high priority isotopes in the report of the Nuclear Science Advisory Committee on Isotopes (NSAC) for targeted radiotherapy. (Department of Energy. NSACI Final Report. URL: http://science.energy.govh/media/np/nsac/pdf/docs/nsaci_final_report_charge1.pdf. Last accessed December 2019). In 2015, NSAC recommended continued funding for R&D and production focused on Actinium-225 ($^{225}$Ac) and $^{211}$At, while also prioritizing shorter lived species (lead/bismuth $^{212}$Pb/$^{212}$Bi, $^{213}$Bi and thorium $^{226}$Th) and longer-lived $^{226}$Th (Nuclear Science Advisory Committee Isotopes (NSACI), Jul. 20, 2015, Meeting Isotope Needs and Capturing Opportunities for The Future: The 2015 Long Range Plan for the DOE-NP Isotope Program, Isotopes Report, p. 160. http://science.energy.gov/~/media/np/nsac/pdf/docs/2015/2015_NSACI_Report_to_NSAC_Final.pdf). $^{211}$At is currently produced by bombarding Bismuth-209 ($^{209}$Bi) with 29 MeV energetic alpha particles. Typically, bismuth metal is evaporated into a metal container to serve as the target. The product, $^{211}$At with a half-life ($t_{1/2}$) of 7.2 hours, is maintained in the cooled target to prevent its premature vaporization. Separation from the target is done via dry distillation at temperatures greater than 650° C. or target dissolution using concentrated acids, to workup and extract the radiochemistry conjugates of $^{211}$At for preclinical studies. The short half-life limits the availability of $^{211}$At to production centers close to the source, which are currently limited to a few cyclotrons located at medical facilities at Universities and one at the National Institutes of Health (NIH). A generator system such as Radon-211 ($^{211}$Rn, $t_{1/2}$~14.6 h) that decays to $^{211}$At could extend the availability of this therapeutic alpha-emitter to a wider pool of users within an overnight delivery timeline.

SUMMARY

Described herein are new material formulations and scalable processes to produce robust $Bi_2O_3$ targets ranging in thickness, size and geometries and substrate types (Aluminum, Titanium and Stainless Steel), typical of currently used target configurations. The target films remained adhered to the substrate and were robust when thermally cycled in air and vacuum off-line. The target materials were characterized for mass, morphology and phase, and any resulting changes to these properties after the heating studies. Minimal changes were observed; however, the choice of precursor materials and substrates influence the outcomes.

Following off-line screening studies, $Bi_2O_3$ targets deposited on stainless steel were evaluated with a $^6$Li beam at Argonne Tandem Linac Accelerator System (ATLAS), by the Argonne National Laboratory (ANL) team. The test apparatus included an in-line heater on which the target was mounted to facilitate release studies by counting the gamma lines from $^{211}$Rn following the beam irradiation. Two in-beam test runs were successfully completed to demonstrate in situ $^{211}$Rn release (estimated at 60-80%) from the target, at temperatures ranging from 575-710° C. The target film survived two rapid heating/cooling cycles to 720° C. in vacuum, before some film spalling was noted.

The targets were also tested at the University of Washington (UW), Medical Cyclotron facility and the University of Pennsylvania (UPenn) Cyclotron facility using their research alpha beam (4-Helium, $^4$He) lines to evaluate the $Bi_2O_3$ target efficiencies over the currently used methods to extract $^{211}$At. Bismuth metal with a melting point of 271.4 C either melts at high beam currents or during dry distillation during Astatine-211 production. When the target is dissolved in concentrated acids, bismuth nitrate is a contaminate. In contrast, $Bi_2O_3$ has a high melting point (817° C.). When used as targets, it can be exposed to heating at high temperatures for extraction of Radon-211, and also for the dry distillation method to extract $^{211}$At without contamination from a melted Bismuth target and/or Aluminum holder. It could also simplify the post-irradiation, multistep wet chemical technique also currently used at UW. $Bi_2O_3$ target materials deposited in cavities in Aluminum holders were provided to UPenn and UW for testing.

It was demonstrated that (1) The films remained adhered to the substrate and retained apparent open porosity ranging from 25-50% (estimated from mass and dimension measurements of the films) after thermal cycling as observed by visual inspection and scanning electron microscopy (SEM) images; (2) Release characteristics of the $^6$Li and $^4$He irradiated targets have been evaluated for different thicknesses of $Bi_2O_3$ films. The target lifetime can be measured in total ion flux measured in ions/cm$^2$ and from this value the required target area for production and release of $^{211}$Rn can also be determined. Since the $^{211}$Rn lifetime is 14 hours, a fast release time is not essential. A release time of up to ~30 minutes for $^{211}$Rn does not limit its extraction efficiency.

While two alpha beam ($^4$He) irradiations completed at UPenn showed an estimated ~30% lower production rate for $Bi_2O_3$ target (30% density of Bi) over the standard bismuth target (made either by melting an ingot of Bi metal (99.999%) or by evaporation of Bi onto an Aluminum (typical) or other backing) these preliminary results at ATLAS and UPenn show that both methods, namely extraction and delivery can successfully provide clinically acceptable levels, ~50 mCi, (Zalutsky MR and Pruszynski M, "Astatine-211: Production and Availability", *Current Radiopharmaceuticals,* 2011, 4:177-185) of $^{211}$At production.

Development of $Bi_2O_3$ Targets on Relevant Substrates and Geometries

Bismuth oxide ink formulations were prepared with two different grades of powders that varied in particle size, <200 nm and <4 μm. The inks were formulated using the $Bi_2O_3$ powders, aqueous low molecular weight polymeric binders, deflocculants and distilled water by varying the composition of the ingredients. The inks were applied by different deposition methods—spin coating, doctor blading and tape casting—to three types of substrates-303 Stainless Steel (SS), Aluminum (Al) and Titanium (Ti)—with different geometries. We chose 303SS and Al as they are commonly used in alpha beam production facilities. Ti is an alternative high temperature substrate, offering a non-reactive and robust target support during heating to release the alpha emitter or its parent. Thick and thin film targets were successfully deposited on these substrates using doctor blading and spin coating techniques followed by heat treatment at temperatures ranging from 600 to 800° C. for varying times. The doctor blading method was preferred as equivalent or slightly higher film densities were obtained using a single deposition and firing step. This is in contrast to the multi-step processing required for the spin coated targets with similar film densities. A total of about 20 disks and 40 sheets were made with variations in composition and processing conditions. This included the $Bi_2O_3$ powder grade, firing conditions, substrate type, substrate size and coating type.

Characterization of $Bi_2O_3$ Target Films and Evaluation of Thermal Cycling

Material properties of the films were investigated, including: (1) film mass; (2) apparent area or volume density from dimensional measurements; (3) particle and pore size morphology from field emission scanning electron microcopy (FESEM) and Energy Dispersive X-ray Spectroscopy (EDS); (4) X-ray diffraction (XRD) of $Bi_2O_3$ powders and deposited films to identify the crystalline phases of the starting materials and films processed at temperatures ranging from 600 to 800° C.; and (5) Differential scanning calorimetry (DSC) on $Bi_2O_3$ powders to monitor phase transformations.

Typical values for film mass and area density of 1, 2 and 3-layer coatings on Ti coupons (1-inch sq., 2-inch sq.) are:

- Ti coupon (n=30); 1-layer: Film mass=70.4±13.7 mg; Area density ~16.4±4.6 mg/cm$^2$,
- Ti coupon (n=3); 2-layers: Film mass=106.7±76.6 mg; Area density ~30.5±7.4 mg/cm$^2$
- Ti coupon (n=3); 3-layers: Film mass=123±117 mg; Area density ~37.5±16.4 mg/cm$^2$ These results demonstrate the ability to scale the deposition of the target material by tuning the ink formulations and processing conditions such as temperature, for example from about 600 to about 650° C., and soak time, for example from about 30 minutes to about 1 hour. Similar trends were noted on Al disks; a 1-layer coating yielded a mass of 13.7±1.5 mg (n=5) and area density of 6.8±0.8 mg/cm$^2$ while a 2-layer coating scaled to a mass of 34.8±4.9 mg (n=3) and area density of 17.3±2.5 mg/cm$^2$. Two Al disks (20 mm dia, 2 mm tall, 16 mm diameter, 75 μm deep cavity) coated with similar mass of $Bi_2O_3$ layers (~40 mg) were delivered to UPenn for evaluation in the alpha beam line.

To meet thick target requirements at UW, $Bi_2O_3$ powders were formulated with suitable polymeric binders and then pressed into pellets under pressure. 2-3 mm thick pellets were processed at high temperatures and then fixed to the base of the cavity in the Al disks, with PELCO—Conductive Carbon Glue (Ted Pella, Inc). Three targets were shipped to UW for evaluation in their experimental beam line.

SEM images of initially processed films showed particles ranging from 300-500 nm with open interconnected porosity (1.2-2.8 μm). These were very similar after 1× thermal cycling. Some particle sintering was noted after 5× thermal cycles. Further, Al from the substrate was noted to have vaporized and deposited on the target film after 5× cycles, as confirmed by EDS. This is attributed to extended heating of the target film and the backing at 600° C. (~10 h), which is close to the Al melting point (660° C.). Evaporation of metallic constituents from the target backing was not seen for films deposited on Ti or 303SS.

XRD of powders indicated that the precursor $Bi_2O_3$ powder, <200 nm, is tetragonal, while the <4 μm powder is monoclinic at room temperature. Since a bulk of the work was carried out with the <200 nm powders to aid in improved ink formulations, high temperature XRD was performed on the processed films. It was noted that one or two phases co-exist at room temperature, depending on the initial processing temperature. The film goes through multiple phase transformations (monoclinic, tetragonal and cubic polymorphs of $Bi_2O_3$) when heated to 520° C., 660° C. and 740° C. This was confirmed by color changes in the target as noted during post-irradiation heating studies of the target. The target remained adhered for 2 irradiation/heating cycles, but spalling was noted after the third cycle. Different grades of the monoclinic form, which transform to the cubic phase at ~730° C. can be evaluated to improve target robustness to heating.

Thermal cycling studies were performed using a vacuum tube furnace. Coated substrates were heated to 600° C., held at this temperature for 2 h and cooled down to 200° C. in each cycle. 1× and 5× cycles were performed on Al disks and Ti coupons coated with $Bi_2O_3$ (two different particle sizes) targets; a negligible mass loss of ~0.15% and ~0.79%, respectively was noted. The films on Ti were visually defect free, while the surface of the films on Al disks appeared discolored with a few cracks after the 5× thermal cycles. For free-standing pellets, a negligible mass loss of ~0.11% was recorded for a single thermal cycle. Despite mechanical abrasion of the Ti substrate to improve adhesion, some delamination of the entire coating from the substrate surface was noted. This is attributed to a stronger cohesive force in the film and a lower adhesive force to the substrate. This can be improved by increasing the oxide layer thickness on the Ti substrate by anodizing or chemical etching. To irradiate the target with $^6$Li beam and carry out post-irradiation heating and release studies of $^{211}$Rn at ANL, the films on 303SS were coated with similar area densities as they remained adhered to the substrate upon heating to temperatures ranging from 500 to 700° C.

Evaluate $Bi_2O_3$ Targets with Lithium-6 Beam at ATLAS

Two in-beam tests and one off-line target heating study were conducted to evaluate $Bi_2O_3$ targets with the $^6$Li beam at the ATLAS user facility. Both runs were performed with a $^6$Li beam, energy of 55 MeV before the window and 49 MeV before the $Bi_2O_3$ targets. Targets were deposited on ¼" thick, ⅞$^{th}$ inch diameter 303SS substrates, with tapped holes for ease of mounting in the beam line. The area density of the targets ranged from 9-15 mg/cm$^2$.

In Run 1, the target was irradiated twice, initially with a low beam current of 2 pnA (particle nano amp) for 3 h and 31 mins. A portable HPGe detector was used to measure the gamma rays to identify the produced isotopes, while a thermocouple was used to record the target temperature during post-irradiation heating. Due to the poor counting statistics from the first trial, the target was re-irradiated for 1 h with a beam current of 12 pnA and heated subsequently. Both the 674.1 and 678.1 gamma peaks for $^{211}$Rn were detected and used in the analysis, while the Copper-61 ($^{61}$Cu) gamma peak at 658 KeV, with a 3.3 h half-life, was used as a reference. The decay of $^{211}$Rn and $^{61}$Cu were analyzed by ROOT (https://root.cern.ch/about-root) a framework for data processing, born at CERN, at the heart of the research on high-energy physics) and GF3 of RADWARE (https://radware.phy.ornl.gov/gf3/autocal.html) software package for interactive graphical analysis of gamma-ray coincidence data that allows the user a choice of at least three different ways to do semi-automatic detector calibrations) using the number of counts, elapsed time and target temperature. Release of $^{211}$Rn from the target was recorded at ~600° C. and confirmed from both analyses. It is estimated that a 75% decrease in $^{211}$Rn at the target was recorded by release and/or evaporation of metallic Bismuth from the target material. This was followed by off-line heating studies on a test target to adjust the in-line heater configuration and heating rate of the target after irradiation.

Run 2 used a similar configuration and beam energies. However, three sequential irradiation/heating experiments were carried out. The first irradiation used 12 pnA beam current over 140 minutes, the second used 12 pnA beam current for 120 minutes, and the third irradiation used 19 pnA for 120 minutes. Heating the target to 650° C. after the first irradiation indicated similar trends for the decay of $^{211}$Rn and $^{61}$Cu with the release of $^{211}$Rn from the target starting at 570-600° C. After the second irradiation of the same target, it was heated to 700° C. and similar trends were observed. After the third irradiation and subsequent heating, the decay curve for $^{211}$Rn indicated no additional release from the target despite heating to 720° C. It was later observed that the repeated irradiation/rapid heating cooling cycles had resulted in target spalling due to the coefficient of thermal expansion (CTE) mismatch between the $Bi_2O_3$ layer and 303SS.

Evaluate of $Bi_2O_3$ Target in the $^4$He Beam Lines

Two coated Al disks were irradiated at UPenn with a 29 MeV alpha beam with 15 μA and 20 μA currents for 1 h without melting of the $Bi_2O_3$ target followed by dry distillation of Astatine-211 from the target at 650° C. Preliminary results indicate that both targets performed well in the beam line with an estimated 30% increase in $^{211}$At production over the standard Bismuth target. Co-production of Fluorine-18 a positron emitter was noted due to the nuclear reaction of the alpha beam with Oxygen-16. The production rates for At-211 and F-18 were roughly 8 MBq/uAh and 1.3 MBq/uAh.

A test irradiation of the 2-3 mm thick pellet target at UW was carried out by increasing the beam current to 1 uA over two minutes, followed by holding the beam current at 1 uA for six minutes. Five minutes after the irradiation, the sample was removed from 1 e-6 torr vacuum to room ambient and inspected. Bubbling and some cracking was noted, possibly due to the porosity in the pellets.

It was concluded, based on results from both the Li beam and alpha beam tests that both target production methods provide the desired results.

BRIEF DESCRIPTION OF FIGURES

FIG. 5A is on 2-inch×0.25-inch 303SS substrate, FIG. 5B is on a 1-inch×1-inch Ti substrate, FIG. 5C is a $Bi_2O_3$ films on Ti substrate coated by doctor blading and fired at 800° C., FIG. 5D is on a 1-inch×0.5-inch Ti substrate, FIG. 5E is on an Al disk with 16 mm diameter, 75 μm deep cavity and FIG. 5F is a ~2-3 mm thick, 13 mm diameter $Bi_2O_3$ pellet.

FIG. 8A illustrates $Bi_2O_3$ films coated on Ti substrates before firing and FIG. 8B illustrates $Bi_2O_3$ films after 5× firing;

FIG. 8C illustrates $Bi_2O_3$ films on Al substrates before firing and FIG. 8D illustrates $Bi_2O_3$ films on Al substrates after 5× firing.

FIG. 13A is after 1× thermal cycle at 1 KX. FIG. 13B is after 1× thermal cycle at 10 KX and FIG. 13C is after 1× thermal cycle at 20 KX.

FIG. 15A is shown at 1 KX, FIG. 15B is at 5 KX and FIG. 15C is at 10 KX.

FIG. 17A shows the $Bi_2O_3$—after 1× thermal cycling (in air) at 600° C. for 5 hours at 1KX, FIG. 17B shows the $Bi_2O_3$ after 1× thermal cycling (in air) at 600° C. for 5 hours at 10 KX, FIG. 17C shows the $Bi_2O_3$ after thermal cycling (in air) at 600° C. for 5 hours at 20 KX, FIG. 17D shows the $Bi_2O_3$ after 5× thermal cycles at 1 KX, FIG. 17E shows the $Bi_2O_3$ after 5× thermal cycles at 10 KX, and FIG. 17F shows the $Bi_2O_3$ after 5× thermal cycles at 20 KX.

FIG. 19A is after 5× thermal cycling (from room temperature to 600° C.) at 1 KX, FIG. 19B is after 5× thermal cycling at 10 KX, and FIG. 19C is after 5× thermal cycling at 20 KX.

FIG. 22A is 80-200 nm $Bi_2O_3$ and FIG. 22B is <4-micron $Bi_2O_3$.

DETAILED DISCUSSION

Figure 1:
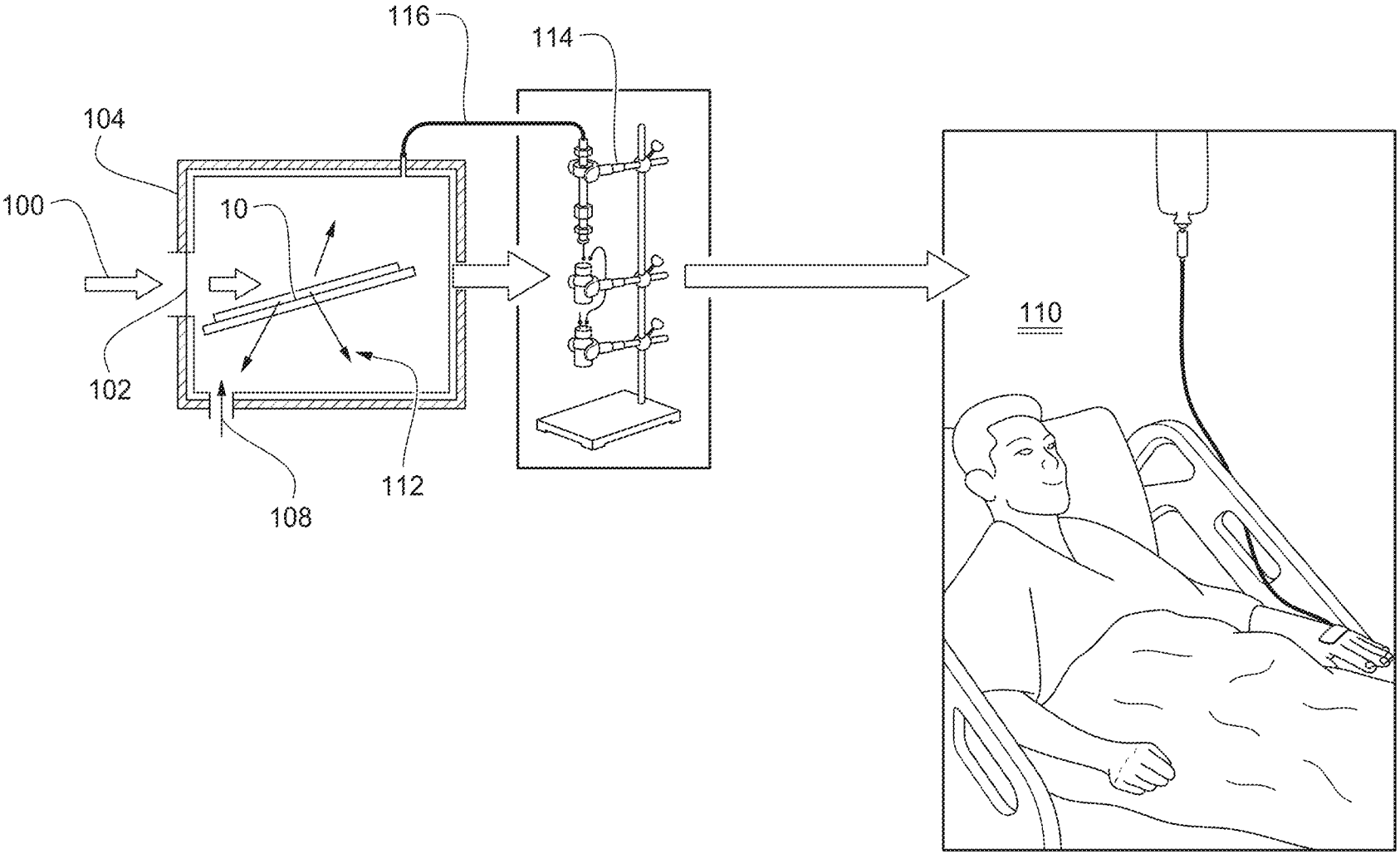
FIG. 1 shows a Lithium beam-induced Radon-211/Astatine-211 generator scheme with a bismuth oxide target, that is applicable to at least two other noble gas/radio halogen generators (Krypton-77/Bromine-77 ($^{77}$Kr/$^{77}$Br) and Xenon-123/Iodine-123 ($^{123}$Xe/$^{123}$I) using arsenic (As) and antimony (Sb) trioxides as targets.

A large area refractory bismuth oxide ($Bi_2O_3$) target was developed to demonstrate the feasibility of an on-line, on-demand route for continuous extraction of the noble gas generator $^{211}$Rn/$^{211}$At for future delivery to user facilities. FIG. 1 shows the generator scheme using a metal oxide target, of which bismuth oxide is an example. This scheme is also suitable for generation of other isotopes, specifically two other radio halogens, namely Krypton-77/Bromine-77 ($^{77}$Kr/$^{77}$Br) and Xenon-123/Iodine-123 ($^{123}$Xe/$^{123}$I). Use of this scheme for $^{211}$Rn/$^{211}$At generator increases the reach of this medically relevant isotope to a wider user community within an overnight delivery schedule. The high temperature stable bismuth oxide target enables continuous on-line extraction of $^{211}$Rn in a helium carrier gas which is collected in a carbon or charcoal column, for overnight delivery to a user facility and processed to extract $^{211}$At. The general reaction formula is:

$$M_2O_{3(s)}+{}^{7}Li\rightarrow N_{(g)}+5n$$

where $M_{(s)}={}^{209}Bi$, $^{75}$As or $^{121}$Sb
and $N_{(g)}={}^{211}Rn$. $^{77}$Kr or $^{123}$Xe (Noble gases)

that decay to Radiohalogens:

$^{211}$At($t_{1/2}$=72 h), $^{77}$Br ($t_{1/2}$=2.78 d), $^{123}$I ($t_{1/2}$=13.4 h)

More specifically, $^{7}Li+{}^{209}Bi_2O_3\rightarrow 5n+{}^{211}Rn$

The methods to produce Bismuth oxide target films include precursors such as nanodispersion of bismuth oxide, or thin films formed from bismuth neodecanoate and bismuth citrate precursors when calcined to yield bismuth oxide thin films. Refractory ceramics such as Bismuth Carbide can also form a target material for the direct production of Astatine-211 from alpha beam irradiation or the Radon-211 parent generator for Astatine-211 with Lithium beam irradiation.

Non-sintering nano-porous $Bi_2O_3$ films on titanium or 303 Stainless Steel (303SS) backing films were developed and evaluated with a $^{6}$Li beam at ATLAS. By bombarding ~50 MeV $^{6}$Li beam on the $^{209}Bi_2O_3$ target, $^{211}$Rn, the parent isotope of $^{211}$At, was produced and released from the target via on-demand heating. Heating the target to high temperatures facilitates continuous extraction of $^{211}$Rn and which is collected in a cryocooled sorbent trap. This longer-lived parent isotope can be transported to $^{211}$At user communities and is not limited by their proximity to a cyclotron production facility. With reference to FIG. 1, a dedicated cyclotron facility with an external $^{6}$Li ion source can generate clinically useful amounts of $^{211}$Rn isotope for shipment daily to user facilities 110. The $^{6}$Li ion beam 100 is directed through a window 102 in a neutron shielded container 104 toward a metal oxide gold backed target film 10 in the container 104. Helium gas 108 fed into the container 104 is used to transport the generated radioactive noble gas 112 that is generated through a conduit 116 to a charcoal trap 114. The source strength of the $^{211}$At extracted from the charcoal trap 114 after 14 hours is about 50% of the initial activity of the $^{211}$Rn. The $^{211}$Rn/$^{211}$At generator scheme increases the availability of the medically relevant isotope to a wider user community by overnight transport to the distant medical facility. In FIG. 1, a high temperature stable bismuth oxide target 106 enables continuous on-line extraction of the radioactive noble gas 112, $^{211}$Rn, in a helium carrier gas 108 that is collected in the charcoal trap (column) 114, for overnight delivery to a user facility 110 and processed to extract $^{211}$At.

Figure 2:
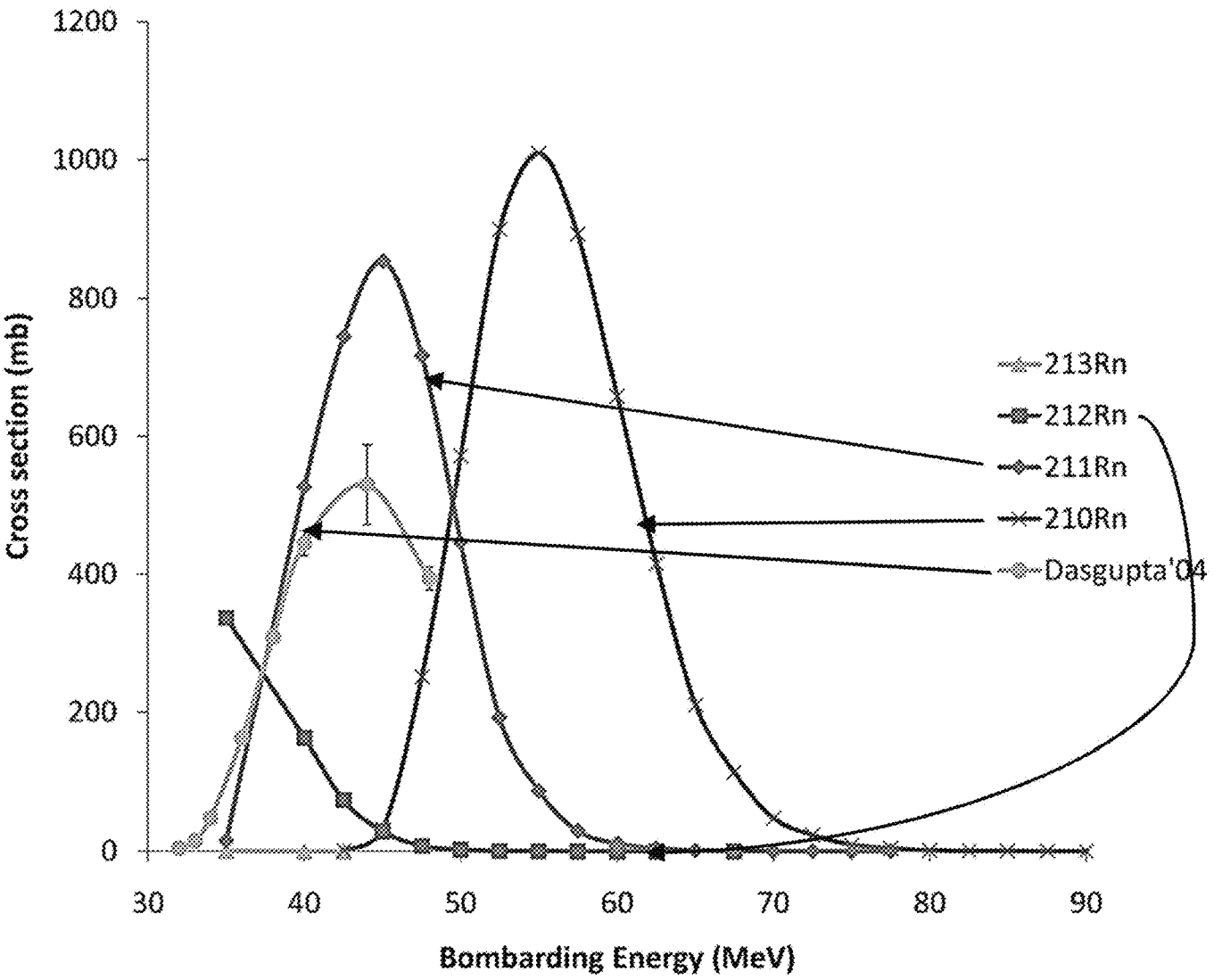
FIG. 2 is a graph illustrating a Lithium induced reaction with beams of different incident energies.

There are 37 known isotopes of radon ($^{86}$Rn), from $^{195}$Rn to $^{231}$Rn; all are radioactive. FIG. 2 is a graph illustrating five radioisotopes of Rn generated by a Lithium induced reaction with beams of different incident energies. For the $^{6}$Li-induced reaction the ideal energy range for production as shown in FIG. 2 is about 50 MeV incident down to 28 MeV exiting. At 28 MeV with thin gold (Au) backings, no residual radioactive isotopes are produced. It is reported by Nolen et. al that investigations into using nickel-backed bismuth thin films as targets for production of $^{211}$At (Greene J P, Nolen J A, Baker S. "Nickel-Backed Bi Targets for the Production of 211At," *Journal of Radioanalytical and Nuclear Chemistry,* 2015, 305(3): 943-946; Nolen J et al. 8*th International Symposium on Targeted Alpha Therapy*, June 4-6, 2013 ORNL, USA) and that an alternative reaction, $^{209}$Bi($^{6}$Li, 4n)$^{211}$Rn (which decays to $^{211}$At) with a 42 MeV $^{6}$Li beam from the ATLAS superconducting linac. Helium (He) gas was used between a thin window and the target to transport the $^{211}$Rn into a charcoal trap. A variation of this method in a larger chamber was used by applicant as well as Nolen et al in tests using the Bismuth oxide target at ATLAS.

Solvent dispersions of nanoscale $Bi_2O_3$ powders were formed and deposited on Ti, Al and 303SS backing plates by spin coating and doctor blading techniques. Screen printing was used previously as well as tape casting techniques, with target film thickness ranging from (10-110 μm). All the films were fired in air at 600 to 800° C., to generate adherent, porous target films. The higher temperature stable $Bi_2O_3$ (melting point ~816° C.) is a significant improvement over the lower melting bismuth metal target (melting point ~272° C.).

Target films were inspected for visible signs of cracking or delamination and subsequently characterized by X-ray diffraction (XRD) analysis for phase, microstructure and pore morphology by SEM. The mass of the backing plate was measured before and after the layer deposition and heat treatment, to estimate film mass, film thickness and area density. Differing firing profiles were evaluated to obtain crack-free, adherent films. Targets of varying thickness were cycled between room temperature and 600° C. in vacuum to establish the thermostability and reusability of the oxide targets through multiple heating and cooling cycles (5×) and ensure that interconnected porosity is retained in the fired films. The prescreened targets of different thickness were evaluated with a $^6$Li beam as described above.

The porous oxide target was formed on different thin metal backing foils, the thin backing metal being selected to provide effective heat transfer in light of the Coefficient of Thermal Expansion (CTE) of each. The CTE of alpha-$Bi_2O_3$ is relatively high at $11\times10^{-6}$/K. (Levin E M, Roth R S. "Polymorphism of bismuth sesquioxide. I. Pure $Bi_2O_3$," *Journal of Research of the National Bureau of Standards A. Physics and Chemistry,* 1964, 68A). Delamination of films deposited on backing materials with different CTEs was investigated by soaking at high temperatures ranging from 600 to 800° C. and cycling from room temperature to 600° C. with a 2 h soak at the high temperature. Robust $Bi_2O_3$ target/backing material combinations enable high alpha beam currents to be used if a dedicated facility optimized for high current alpha beams is available. A single cyclotron facility with an external ion source can deliver 50 MeV Li-6 and 33 MeV 4-helium beams, enables switching between the two production reactions. Direct astatine production is more appropriate for nearby customers while production and shipping of the $^{211}$Rn precursor enables over-night delivery to the user community.

The porous nanoscale $Bi_2O_3$ target is used to establish general considerations for the formation of other metal oxide target films e.g., arsenic and antimony trioxide. It was assumed that an approximately 1 cm$^2$ beam cross section would be delivered to a tilted target with a 7-degree grazing angle. This spreads the 1 cm$^2$ beam spot over 10 cm$^2$ area on the surface of the target. For a 50 MeV $^6$Li beam, the useful energy range for production of $^{211}$Rn is down to 28 MeV at the exit. The target thickness along the beam is then ~200 μm (~100 mg/cm$^2$ assuming 50% porosity). Also, the target film thickness is only 20 μm in the direction of thermal conductivity. Hence, even considering the reduced thermal conductivity due to the porosity, the ΔT™ across the film is ~10° C. at a beam power of 5 kW, which is much higher than presently used for $^{211}$At production.

The processes for forming the $Bi_2O_3$ target and characteristics of the product formed enable the development of a target for efficient production of the generator $^{211}$Rn. The use of $Bi_2O_3$ enables the dual use (1) collection of the generator $^{211}$Rn and (2) the alpha-beam induced direct production of $^{211}$At. The production of the $^{211}$Rn/$^{211}$At generator greatly extends the nationwide availability of the isotope by effectively doubling its life-time. A dedicated cyclotron facility with external ion sources for high currents of both Li and He beams can be implemented commercially as a nationwide provider of $^{211}$At. Some of the specific advantages of alpha vs. lithium production routes are.

a) Alpha (Helium-4):
(1) Cross section gives somewhat larger initial activity;
(2) dry distillation or wet extraction separations and chemistry are established for $^{211}$At;
(3) target must be dissolved each run; and
(4) Factor of 4 decay (2 half-lives) obtained with overnight delivery.

b) Lithium:
(1) 14-hour half-life >useful yield 1-3 days after production;
(2) Continuous extraction of $^{211}$Rn from the target; and
(3) Simple physical extraction of $^{211}$At from the "generator."

The development of the thermally stable higher melting $Bi_2O_3$ targets opens up opportunities to provide $^{211}$At at higher beam currents without loss of target material, as well as high current production of the longer-lived generator, $^{211}$Rn.

Table 1 summarizes how the features of the described technology offers distinct advantages over current approaches.

TABLE 1

Features, Advantages, and Benefits of $Bi_2O_3$

| Feature | Advantage | Benefit |
|---|---|---|
| Robust, $Bi_2O_3$ target; extension to other oxide targets. | Efficient on-demand release and continuous extraction of the noble gas precursor | Higher production rates of $^{211}$Rn/$^{211}$At Other radio halogens feasible |
| $^6$Li induced parent-daughter generator system | Concept for dedicated linac or cyclotron for radio halogen production | Overnight delivery to users from single national facility |

Adherent $Bi_2O_3$ films formed on 2-inch diameter substrates retained 25-50% interconnected porosity after rapid firing at 600° C. in air for 30 mins. More specifically, $Bi_2O_3$ films were deposited on planar substrates of 303SS and Ti with different geometries, including 2-inch×2-inch Ti substrates and 16-mm diameter, 75-micron deep cavities in Al disks. The $Bi_2O_3$ films remained adhered to 303SS and Al substrates upon thermal cycling and retained 25-50% porosity upon 5× thermal cycling from room temperature to T=600° C. with a 2-hour soak. However, small cracking was noted after 5× thermal cycling due to evaporative loss of Al from the substrate that redeposited on the target film, and the $Bi_2O_3$ films showed inconsistent adhesion to the Ti substrates upon thermal cycling. Large area $Bi_2O_3$ films were also prepared on 6-inch diameter Ti substrates using doctor blading to demonstrate scalability of the coating process.

On-line measurements at ATLAS were successfully completed in two separate runs with a total of five irradiations followed by target heating. The release of $^{211}$Rn from the target was demonstrated by heating at temperatures ranging from 570 to 700° C. with an estimated 60-80% efficiency. The release efficiency was found to increase with an increase in target temperature. Further, the target did not significantly evaporate at these temperatures. A key finding was that the oxide is usable (robust) up to ~700° C. and therefore the nano-structure appears not to be as critical as is good adhesion to the backing and minimal reduction of the oxide in the contact layer with the backing.

Irradiations on two targets were completed at UPenn. The $Bi_2O_3$ target appeared to perform well in the beam line, with ~30% increase in $^{211}$At production yield over the conventional Bismuth target, with coproduction of Fluorine-18 ($^{18}$F) from Oxygen-16 ($^{16}$O).

Fabrication of Nano-Porous $Bi_2O_3$ Thin Film Targets on Relevant Substrates

Substrates of different geometries and materials chosen for deposition of $Bi_2O_3$ target films were fired for off-line and in-beam testing. To gain the flexibility to deposit films of any geometry (circular, rectangular, square annulus etc.), printing inks were developed using nanoscale $Bi_2O_3$ powders with different particle sizes (80-200 nm and with <4 μm) available from Alfa Aesar were produced by standard methods. The constituents, namely $Bi_2O_3$ powder, (Hydroxypropyl)methyl cellulose and distilled water were weighed and first mechanically blended by means of a spatula or paddle. Final mixing was then performed using a high shear blender to obtain proper rheology. The constituent concentrates were optimized for proper rheology and layer thickness. The inks were also de-aired by rolling them on a ball mill.

To accommodate experimental on-line testing in an alpha beam at UPenn circular Al and 303SS disks (20 mm diameter) with a 16 mm diameter, 75 μm deep cavity were used. Ti sheets of various sizes (0.5"×1", 0.25"×2", 1"×1" and 2"×2") were used for initial testing. In order to improve the film uniformity and adherence to the substrate, the Ti sheets were surface ground manually using P1500 grit alumina grinding paper. Machined and polished 303SS substrates were passivated to form an oxide layer prior to deposition. Aside from cleaning, no special preparation was used with the machined Al disks as it was believed that the native aluminum oxide acts as good interfacial bonding layer for the $Bi_2O_3$ target. Since the $Bi_2O_3$ target was being formed on metal substrates, it was important to select a backing metal for effective heat transfer while being cognizant of matching the CTE. Table 2 lists the CTE of various metal substrates and their oxides, along with the Bismuth metal. To understand the effect of thermal mismatch and film adherence on to the substrate Ti, 303SS and Al were selected because they span the lower, mid and high ranges of CTE respectively. Al and 303SS are commonly used target backing materials, affirming the choices. Further, it can be seen from the values in Table 2 that aluminum oxide, Ti and titanium dioxide have CTEs close to that of $Bi_2O_3$ while iron oxide and 303SS are significantly different.

TABLE 2

Thermal Expansion Coefficients of Various Metals and Metal Oxides*

| Metal | CTE ($10^{-6}$/K) | Metal Oxide | CTE ($10^{-6}$/K) |
|---|---|---|---|
| Aluminum | 21-24 | Aluminum oxide | 8.1 |
| Bismuth | 13-13.5 | Bismuth oxide | 6-9 |
| Silver | 19-19.7 | Silver oxide | −9.02 |
| Stainless steel 303 | 17.3 | Iron oxide | 1-2 |
| Titanium | 8.5-9 | Titanium dioxide | 8.4-11.8 |
| Zirconium | 5.85 | Zirconium dioxide | 0.108 |
| Gold | 14.2 | | |
| Platinum | 9 | | |

*Laser and Optics User's Manual. Material Expansion Coefficients: Linear Thermal Expansion Coefficients of Metals and Alloys. Agilent technologies, Chapter 17, pages 1-12, 2002; "Thermal expansion coefficients of metal oxides". www.AZoM.com - An AZoNetwork Site. Owned and operated by AZoNet. 2000-2019

Doctor blading technique and spin coating, were employed to coat $Bi_2O_3$ on the various substrates described above. In the doctor blading technique, a glass plate served as the casting surface. The substrate (Al/303SS disks or Ti sheet) was adhered to the glass plate using tape. A "knife edge" or "doctor blade" consisting of a solid, rigid piece of metal, wider than the separation distance between the casting plates was used. The ink was poured into a trough and the doctor blade was then drawn over the trough to spread the ink over the substrate. Various samples of the cast film were then dried at room temperature (RT) for times ranging from 16 to 24 h (typically overnight). A few Ti sheets were also spin coated using 500 μL of ink at 1000 rpm for 1 minute followed by 500 rpm for 3 minutes. The thickness of resulting $Bi_2O_3$ film was controlled by varying the spin speed. In order to obtain very thick films, repeated spin coating depositions were performed on the same sample.

Films ranging in thickness from 28-32 μm were deposited by doctor blading technique on to Ti substrates with one layer of coating. Using the spin coating technique similar thickness (28-32 μm) films were obtained with 4 layers of coating. Thicknesses of ~8 μm, ~18 μm and ~25 μm resulted from first, second and third layer of spin coating and fired films deposited on polished Ti sheets, respectively. This clearly indicates that the spin coating procedure is process intensive, requiring multiple steps to achieve equivalent film thicknesses. Hence, the further films were prepared using the doctor blading technique. With this technique the targeted thickness of 30 μm was achieved, which is desired since a 10× increase in area can be achieved with a grazing incidence beam of ~7°. This aligns with reports that the beam power is dissipated better in thinner targets with proper backplate cooling. (Zalutsky MR. "Production of Astatine-211 at the Duke University Medical Center for its Regional Distribution." Final Technical Report DOE-Duke-8775-1, January 2015)

Figures 3A, 3B:
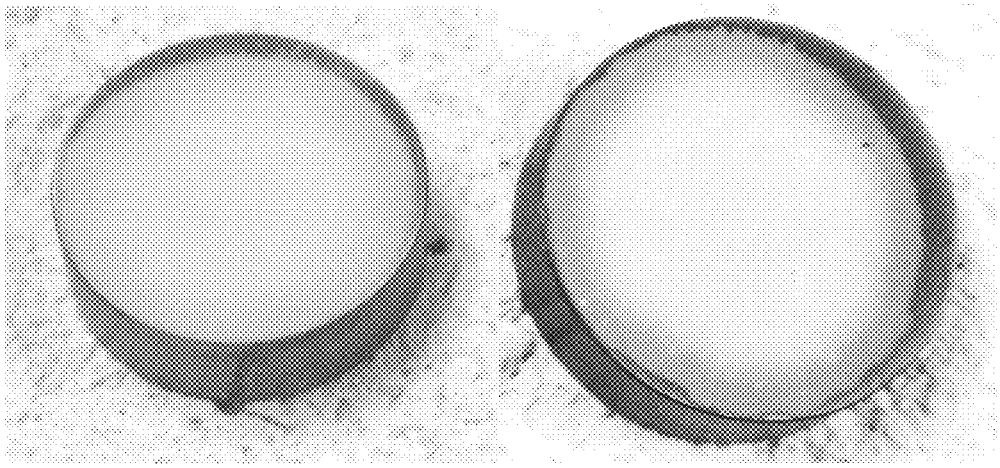
FIG. 3A shows two layers of bismuth oxide coating after deposition on 303SS using doctor blading technique.
FIG. 3B shows the two layers of bismuth oxide of FIG. 3A on 303SS after sequential firing at 600° C. for 30 minutes in air.
Figure 4:
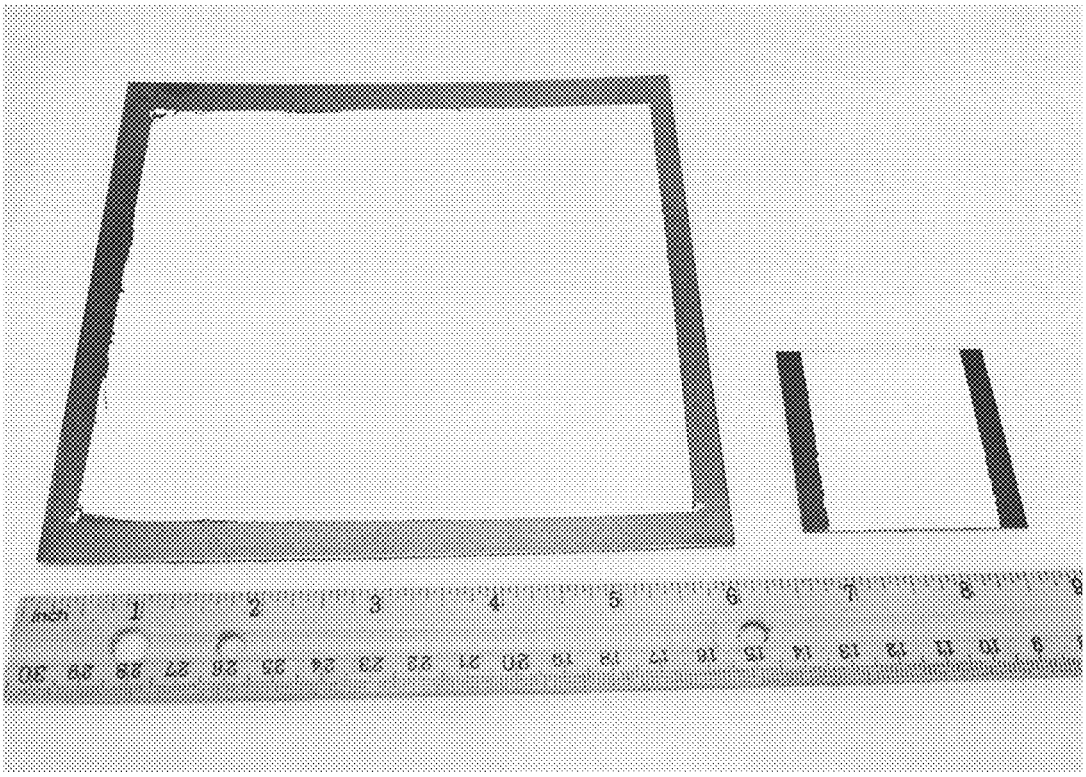
FIG. 4 shows bismuth oxide film coated on 6-inch and 2-inch square Ti sheets using doctor blading technique and fired at 600° C. for 30 minutes in air.
Figure 5A:
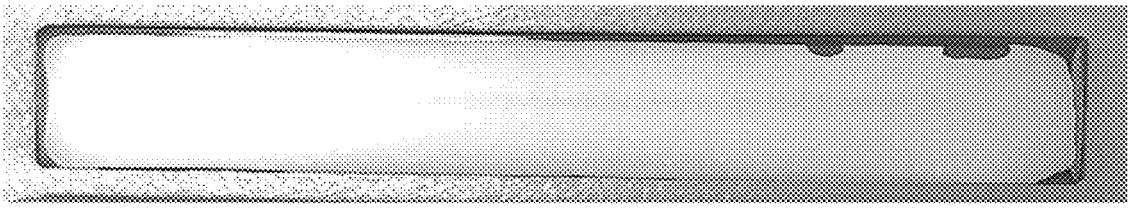
FIGS. 5A-5F show $Bi_2O_3$ films coated using doctor blading and fired at 600° C. where
Figure 5B:
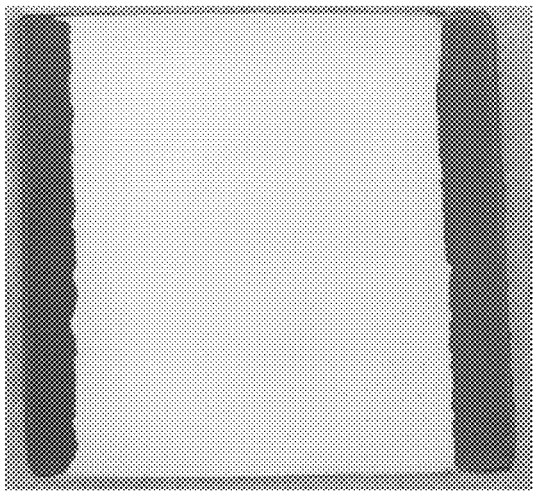
Figure 5C:
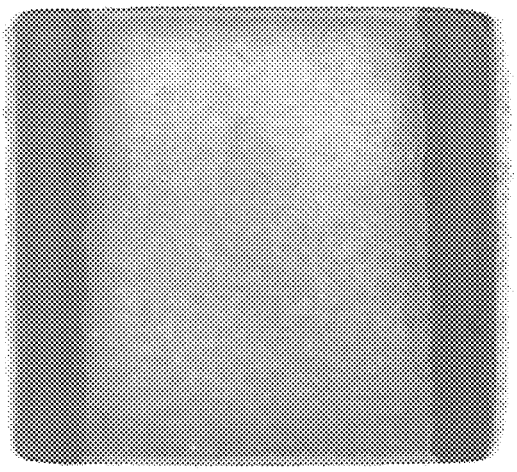
Figure 5D:
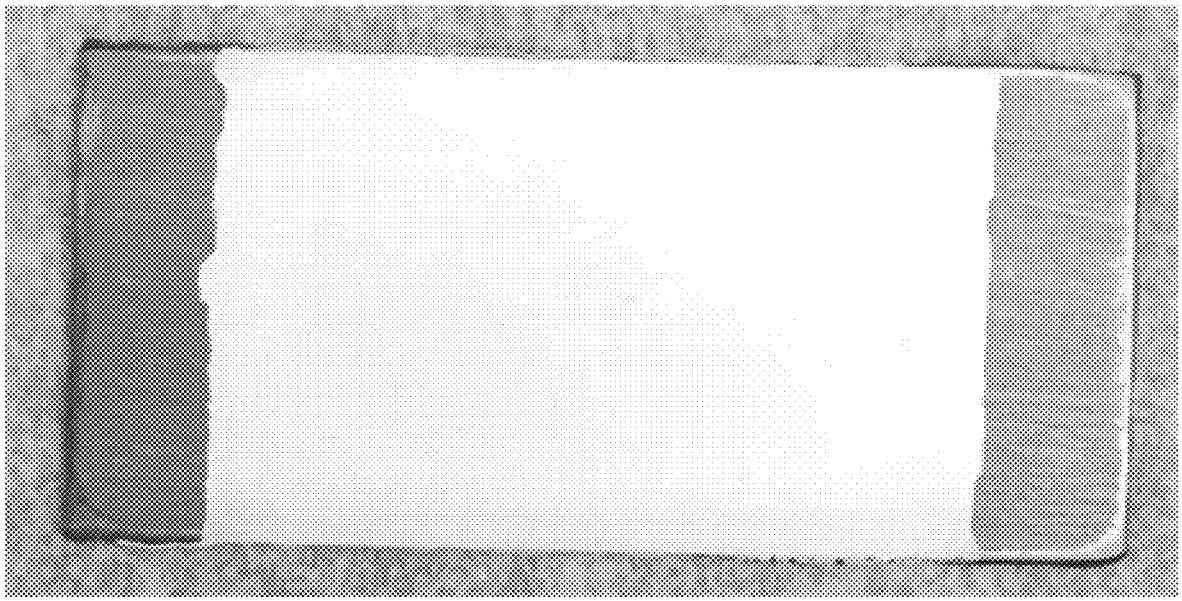
Figure 5E:
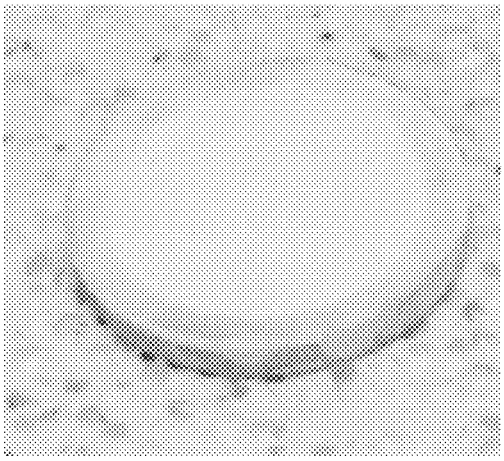
Figure 5F:
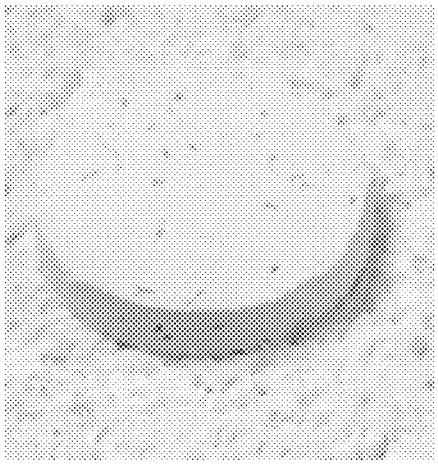

Coated substrates were dried at room temperature (RT) overnight to remove all organic carrier materials and then rapidly fired for 30 minutes in air in a muffle furnace held at 600, 700 or 800° C. Based on the firing results, the 600° C. processing temperature was selected as it enables the formation of an adherent, yet porous film on the backing plate (Al, Ti, 303SS). FIG. 3A shows the wet printed $Bi_2O_3$ film and FIG. 3B shows the fired $Bi_2O_3$ film coated on 303SS substrates using the doctor blade technique. Films with initial thickness 28-32 μm were deposited on ⅞$^{th}$ inch diameter, ¼" thick substrates as candidates for irradiation studies at ATLAS. The scale up capabilities was demonstrated by depositing and firing the $Bi_2O_3$ films on 2-inch and 6-inch square Ti substrates (FIG. 4, right and left respectively).

Further, to meet custom target configurations for use at UW pellets were also made by adding binders (2.5% w/w PEG 300 and 2.5% w/w PEG 4000) to $Bi_2O_3$ powders. The pellets were prepared by mixing the binders and $Bi_2O_3$ powder in a motor pestle for an hour, pre-drying the powders in an oven set to 180° C. to drive off moisture, and pressing the mixture using a 13 mm die and a Carver press at 2000 psi and 120° C. for one minute. The pellets made with different grades of $Bi_2O_3$ were fired at 650° C. for 4 hours, glued to Al/303SS disks for evaluation as targets at UW. FIGS. 5A-5F show fired $Bi_2O_3$ films deposited on several substrate types and geometries including free-standing fired pellets.

Grades of $Bi_2O_3$:

As mentioned above, two different grades of $Bi_2O_3$ with varying particle size were used: (a) 80-200 nm and (b)<4 μm. Some of the films deposited with <4 μm particle size started peeling off from one edge after firing in the furnace. The ones that adhered to the substrate (Al disks and Ti sheets) were vacuum fired, but cracks started appearing on the film after 1× vacuum cycling. Therefore, a majority of the studies were then performed using the nanoscale $Bi_2O_3$ powders. A total of 10 Al disks, 10 303SS disks and 40 Ti sheets were coated with the ink formulations; and 10 pellets of $Bi_2O_3$ were made. Both sets of disks and sheets were robust enough to be handled for mass and dimension measurements.

Figure 6:
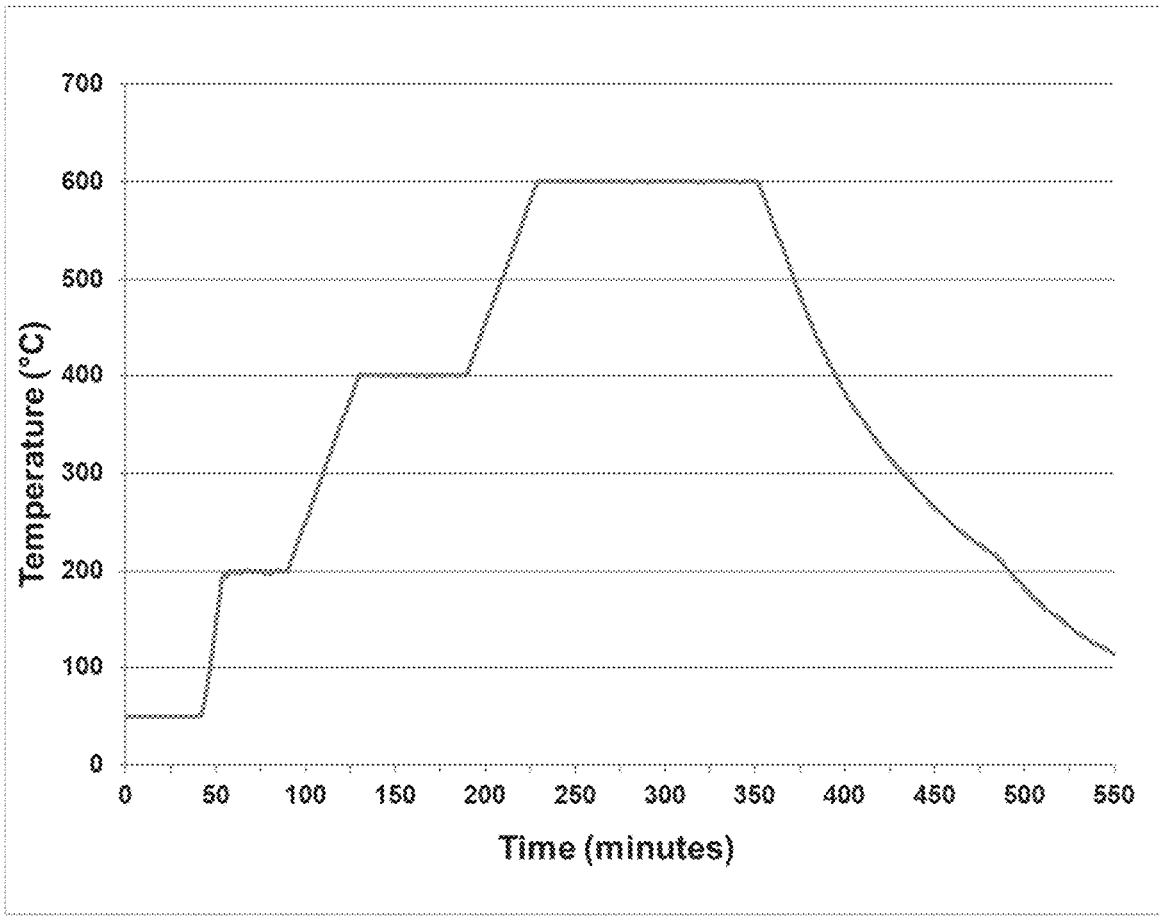
FIG. 6 is a graph of the heating and cooling profile applied to $Bi_2O_3$ films during thermal cycling.
Figure 7:
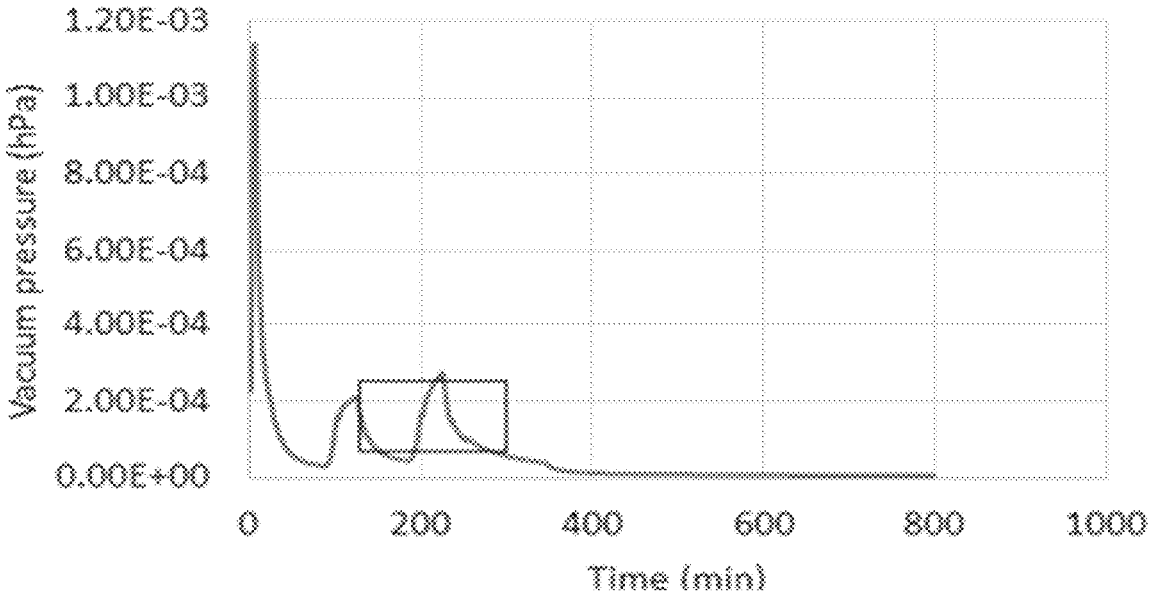
FIG. 7 is a graph of the vacuum profile during the heating and cooling cycle shown in FIG. 6.

Characterizing $Bi_2O_3$ Thin Films and Evaluating Their Robustness to Thermal Cycling Thermal cycling—To ensure target materials remain adhered to the substrate during off-line heating to release $^{211}Rn$ or $^{211}At$, the thermal stability of the developed targets was investigated. The cast films after drying at ambient conditions were fired at 600° C. for 30 minutes and then subjected to thermal cycling studies using an MTI tube furnace equipped with vacuum fittings. A new quartz tube was installed in the MTI tube furnace, and new ceramic plugs were used during firing of each of the samples to prevent cross contamination. The vacuum tube furnace (MTI) heating profile for one cycle at 600° C. is shown in FIG. 6. The firing profile starts with sample at RT with a ramp rate of 40 minutes every 200° C. until it reaches 600° C. After the sample reaches 600° C., it is soaked for two hours at 600° C. and then cooled back to room temperature. The pressures were at 1.59 E-05 hPa ($1.19\times10^{-5}$ torr) in the beginning and 1.15 E-05 hPa ($8.63\times10^{-6}$ torr) at the end of the cycle. The vacuum profile for the heating cycle shown in FIG. 6 is shown in FIG. 7.

A series of thermal cycling tests with the ⅞" diameter SS disks, 1"×1" Ti substrates and the Al disks coated with $Bi_2O_3$ were conducted. Coatings fired in the muffle furnace as part of the initial processing, were placed on a zirconia block along with a 1"×1" quartz sheet placed vertically in a groove in the zirconia block, as shown in FIGS. 8A-8D. The quartz sheet was placed in the direction of vacuum and next to the samples to determine if any bismuth would be deposited on its surface. Next, the zirconia block with samples and the quartz were placed inside the tube furnace for thermal cycling studies. The weight of each sample was measured before and after firing and the mass loss was calculated. Test samples were also visually inspected and photographed before and after the heating studies.

Figure 8A:
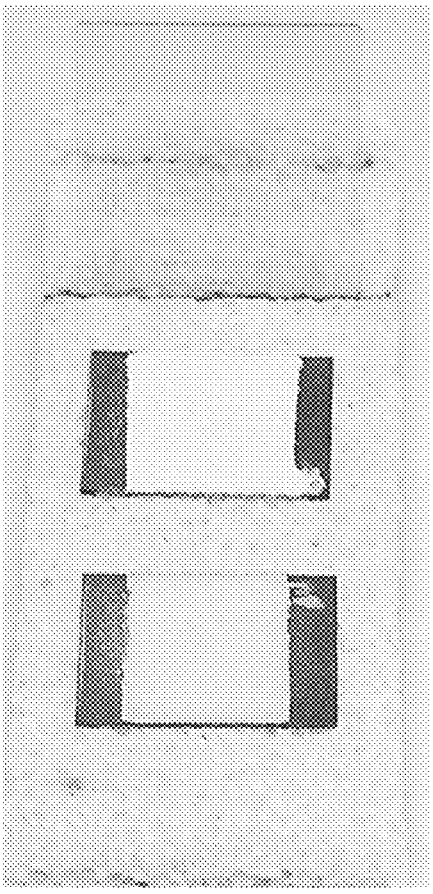
FIGS. 8A-8D show Bismuth oxide targets processed from particle size, 80-200 nm (top of image) and <4 μm (bottom of image) where
Figure 8B:
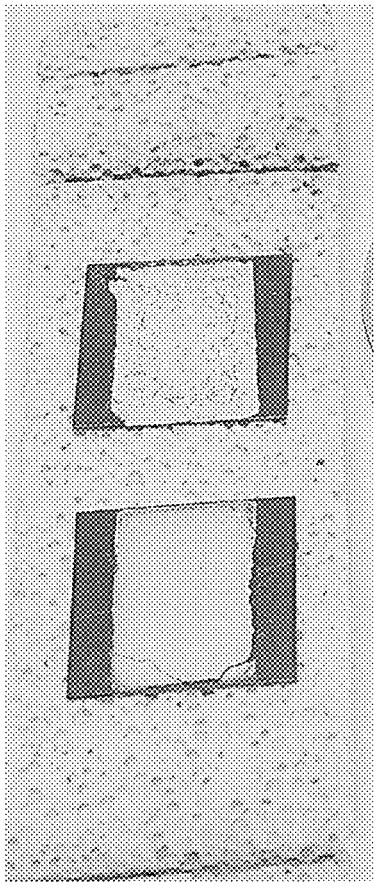
Figure 8C:
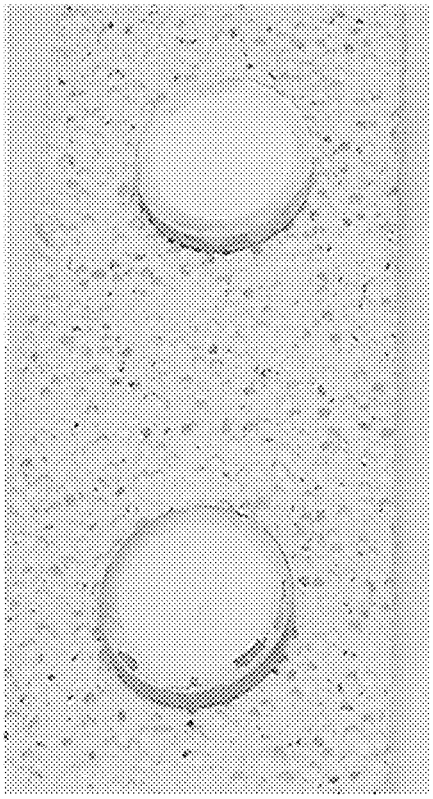
Figure 8D:
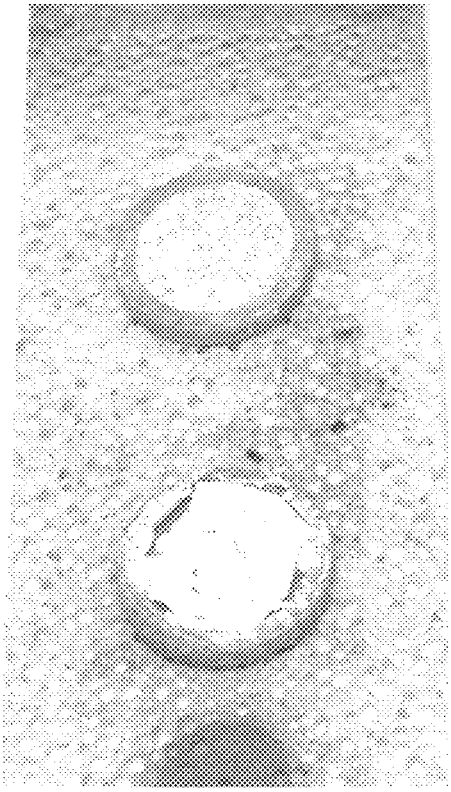

FIGS. 8A-8D show the two different $Bi_2O_3$ grades used in the target films (particle sizes of 80-200 nm (top portion of each image) and <4 μm)(bottom portion of each image)) deposited on Ti and Al substrates (placed on top of zirconia block). FIG. 8A shows the Ti substrate before thermal cycling and FIG. 8B shows the Ti substrate after 5× thermal cycling. FIG. 8C shows the Al substrate before thermal cycling and FIG. 8D shows the Al substrate after 5× thermal cycling. From the images it was noted that Ti substrates are more stable than Al for repeated cycling. As Al melts at 660° C., extended soaking at 600° C. and or thermal cycling caused evaporative loss of Al from the disk with some deposition of Al on the zirconia block. Further, cracks appeared on the films with <4-micron size $Bi_2O_3$ starting material on both Al and Ti substrates.

In addition to firing the $Bi_2O_3$ deposited onto substrates, standalone $Bi_2O_3$ pellets were also fired. The pellets were intact, and no crack formation was seen on the pellets after 1× thermal cycling. The mass deposited and the mass loss after firing $Bi_2O_3$ on Al disks, Ti sheets and pellets are set forth in Table 3. It should be noted that the mass loss is not significant in 1× thermal cycling for all the substrates and the pellets. An increase in mass loss after 5× thermal cycling was observed with both grades of $Bi_2O_3$. Further, the mass loss was greater in nano-porous $Bi_2O_3$ (80-200 nm) than in $Bi_2O_3$ with <4 μm particle size for $Bi_2O_3$ deposited on Al disks. A lower mass loss (0.03% to 0.4%) was recorded when target coatings on Ti substrates were heat treated in air, at temperatures ranging from 600 to 800° C. and soak times of 2 h and 5 h. These results suggest that the target films with larger particle size are relatively stable upon heating in air.

TABLE 3

Film Mass/Mass Loss Summary for Targets After Vacuum Thermal Cycling

| Sample ID | $Bi_2O$ particle size | Number of layers | Number of thermal cycles | Film Mass before firing (mg) | Mass loss % |
|---|---|---|---|---|---|
| Ti-1 | 80-200 nm | 1 | 1x (vacuum) | 77.1 | 0.79% |
| Ti-2 | <4 μm | 1 | 1x (vacuum) | 59.46 | 0.55% |
| Ti-1 | 80-200 nm | 1 | 5x (vacuum) | 77.1 | 1.15% |
| Ti-2 | <4 μm | 1 | 5x (vacuum) | 59.46 | 0.85% |
| Al-1 | 80-200 nm | 3 | 1x (vacuum) | 45.87 | 0% |
| Al-2 | <4 μm | 3 | 1x (vacuum) | 81.0 | 0.01% |
| Al-3 | 80-200 nm | 2 | 5x (vacuum) | 30.5 | 1.67% |
| Al-4 | <4 μm | 2 | 5x (vacuum) | 73.9 | 1.18% |
| Pellet-1 | 80-200 nm | NA | 1x (vacuum) | 1341.3 | 0.1% |
| Pellet-2 | <4 μm | NA | 1x (vacuum) | 1656.3 | 0.11% |

Film Thickness and Morphology—

Establishing a $Bi_2O_3$ deposition procedure that generates a uniform film with a controlled thickness has been demonstrated. Thickness was controlled by using a single tape during doctor blading for repeated depositions. Thickness of a few films was estimated from measurements using a Dektak 3030 stylus profilometer. Table 4 lists the film processing parameters, the measured mass and thickness estimated from profilometry and the area density for 303SS disks coated using spin coating method. Ti sheets and Al disks were coated using doctor blading technique. More mass could be deposited with increasing thickness by doctor blading technique than by spin coating. Film thickness was also estimated by SEM analysis. Samples deposited and fast fired at 600° C. in a muffle furnace were investigated. SEM analysis was performed at an angle of 44.6° with the film thickness extracted geometrically. The thickness measurement from SEM agrees with the profilometry measurements.

TABLE 4

Processing Conditions, Mass, Density and Thickness of $Bi_2O_3$ Films

| Sample ID | Coating method | Layers | Film thickness (μm) | Film Mass (mg) | Area Density ($mg/cm^2$) |
|---|---|---|---|---|---|
| SS-1 | Spin | 3 | 5.03 | 17.37 | 4.46 |
| SS-2 | Spin | 3 | 4.79 | 16.53 | 4.25 |
| SS-3 | Spin | 3 | 4.55 | 15.7 | 4.03 |
| Ti-1 | Doctor blade | 1 | 59.5 | 92.00 | 16.30 |
| Ti-2 | Doctor blade | 1 | 32.19 | 77.4 | 17.19 |
| Ti-3 | Doctor blade | 1 | 30.77 | 73.9 | 16.42 |
| Al-1 | Doctor blade | 2 | 37.62 | 40.4 | 20.09 |
| Al-2 | Doctor blade | 2 | 35.88 | 38.5 | 19.16 |
| Al-3 | Doctor blade | 3 | 42.56 | 45.7 | 22.73 |

Figure 9A:
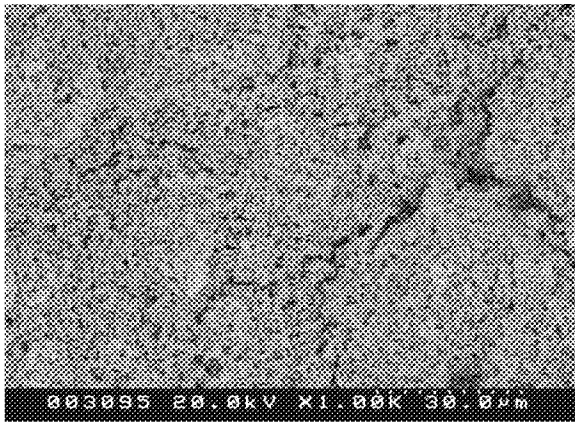
FIG. 9A-9I are SEM micrographs of the nano-porous $Bi_2O_3$ (80-200 nm) on Al disk: where 9A is at 1 KX, 9B is at 10 KX, 9C is at 20 KX, before thermal cycling; 9D is at 1 KX, 9E is at 10 KX and 9F is at 20 KX after 1× thermal cycle; and 9G is at 1 KX, 9H is at 10 KX, 91 is at 20 KX and after 5× thermal cycles.
Figure 9B:
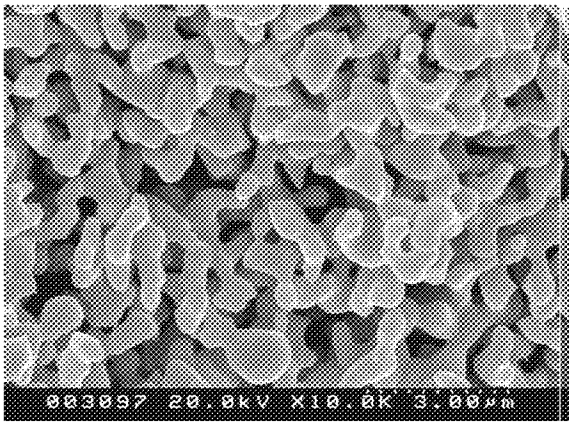
Figure 9C:
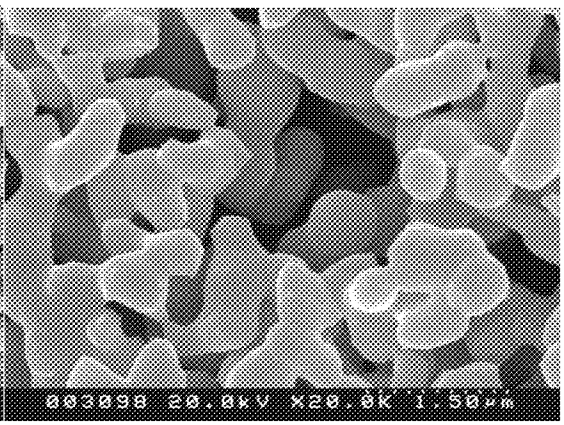
Figure 9D:
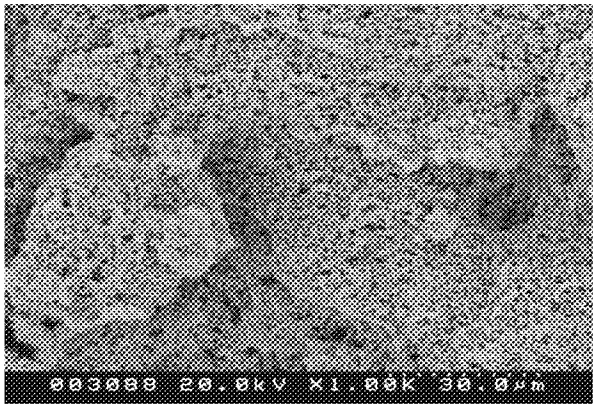
Figure 9E:
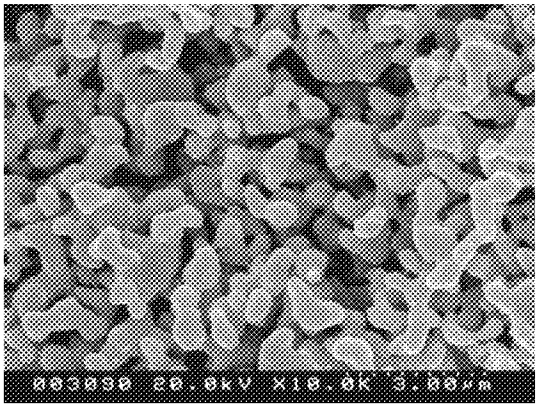
Figure 9F:
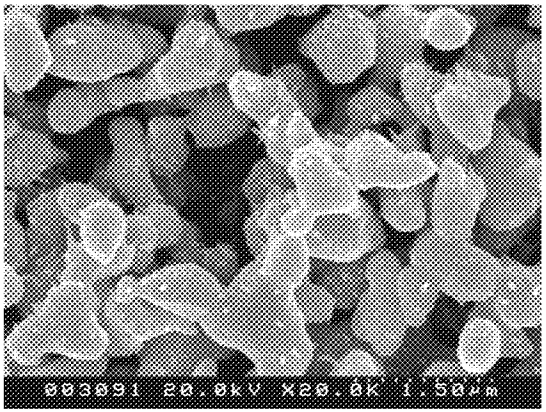
Figure 9G:
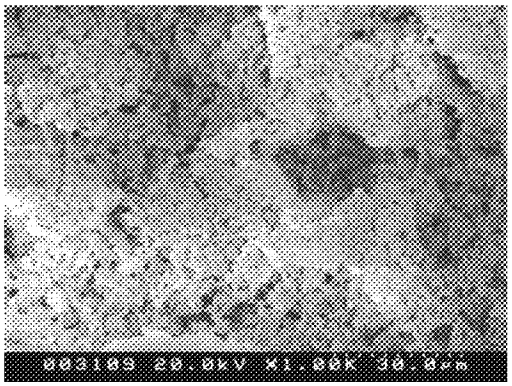
Figure 9H:
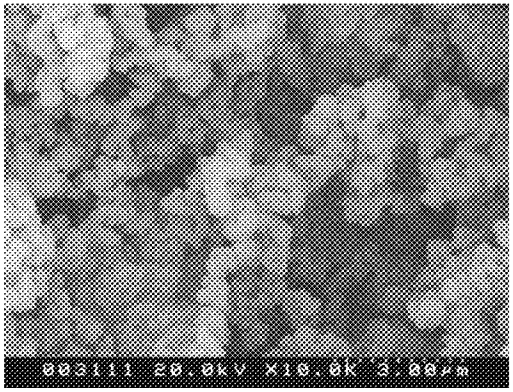
Figure 9I:
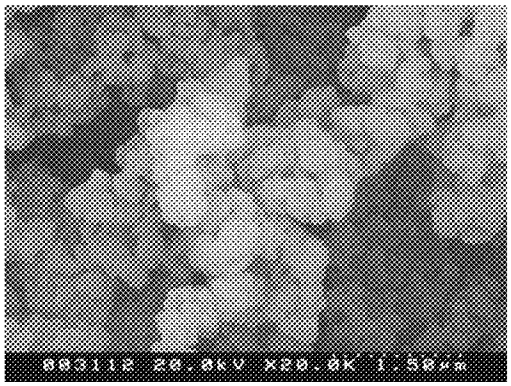

FIG. 9A-9I show the surface morphology of the $Bi_2O_3$ (80-200 nm) films coated using doctor blading and fired at 600° C. after coating deposition, after an initial firing for and after 5 cycles at three different magnifications. FIGS. 9A-9C show $Bi_2O_3$ on Al discs as deposited at 1×, 10× and 20× magnification. FIGS. 9D-9F are the same samples after one thermal cycle and FIGS. 9G-9I are the same samples after five thermal cycles. Small crystallites of $Bi_2O_3$ are seen in each of FIGS. 9D-9F after one thermal cycle, the whiskers being more readily seen at 10 KX and 20 KX magnification (FIGS. 9E and 09F). This could be small amounts of evaporated bismuth metal depositing back on to the target during the thermal cycle. Further, the $Bi_2O_3$ particle morphology is masked after 5× thermal cycles on Al disks (FIGS. 9G-9I). The evaporated Al redeposits on the target with repeated soaks at 600° C. Also, the SEM images (FIGS. 9G-9I) show that there was material loss during the vacuum cycling as evidenced by the mass loss and meso-porosity in the particles in the films.

Figure 10:
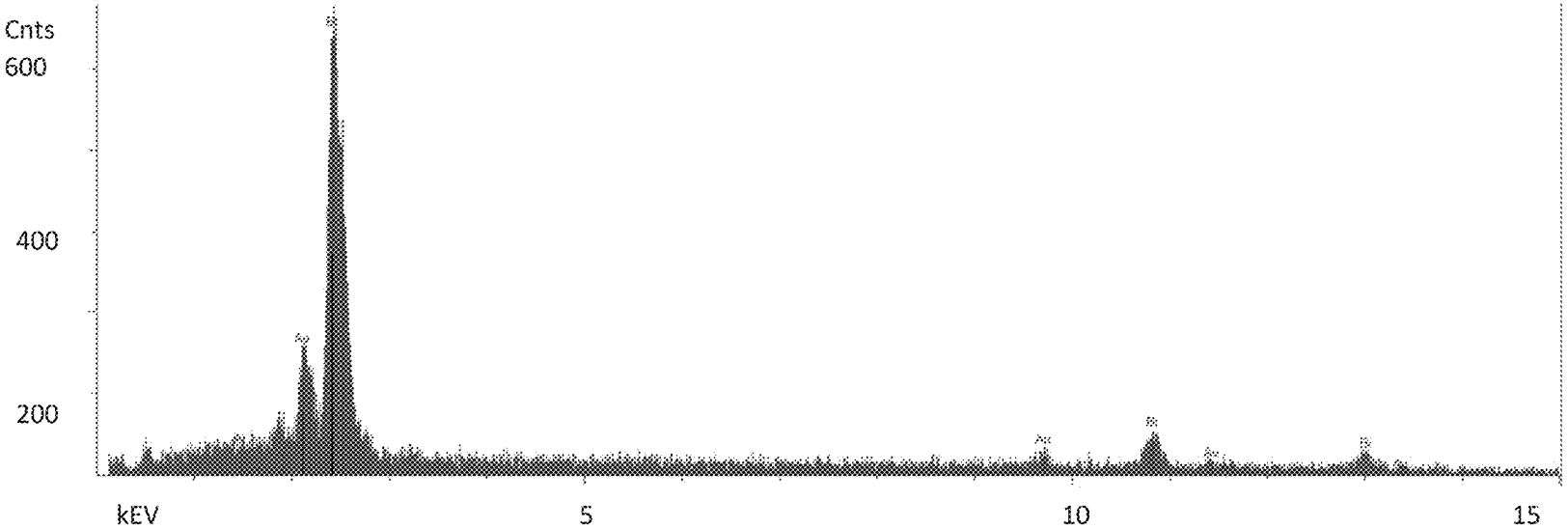
FIG. 10 shows an EDS scan of the nano-porous $Bi_2O_3$ (80-200 nm) film on an Al disk before thermal cycling.
Figure 11:
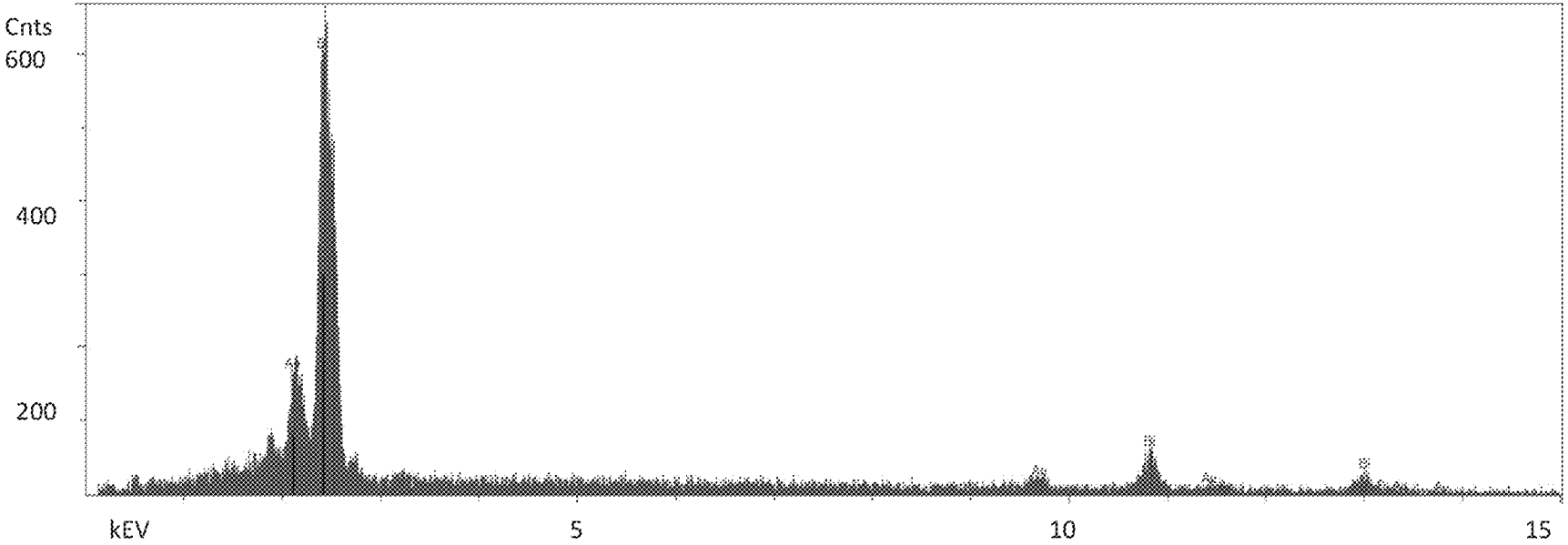
FIG. 11 shows an EDS scan of the nano-porous $Bi_2O_3$ (80-200 nm) film on an Al disk) after 1× thermal cycling.
Figure 12:
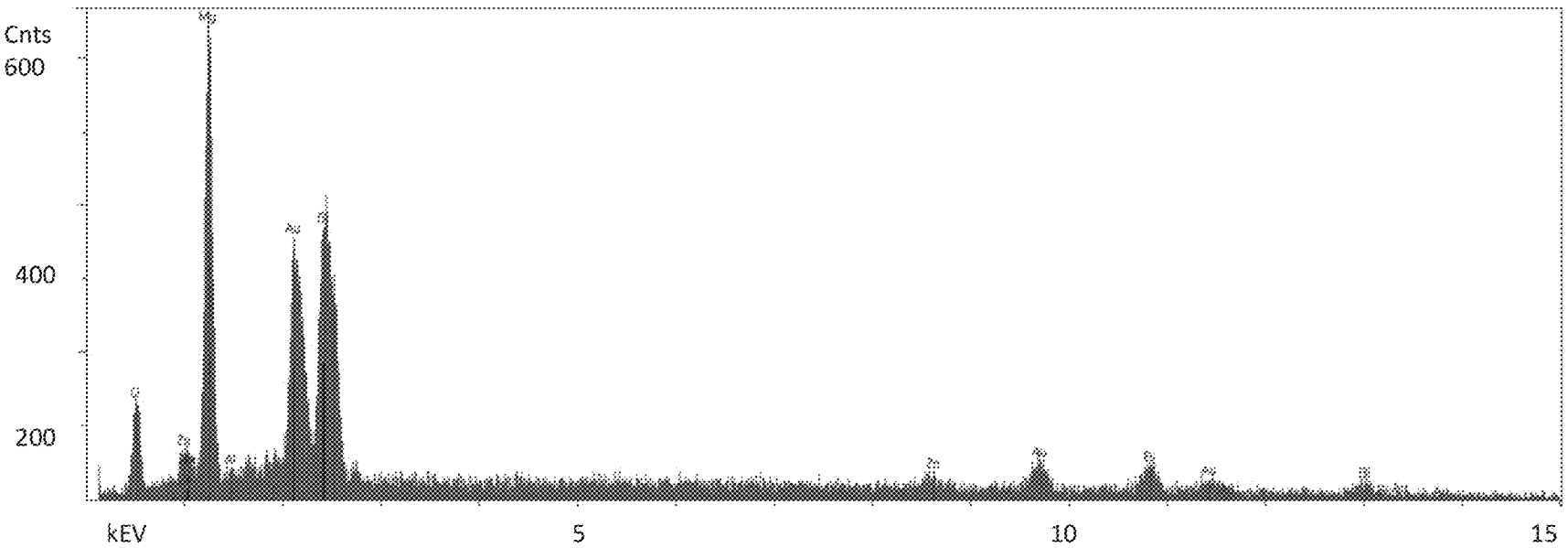
FIG. 12 shows an EDS scan of the nano-porous $Bi_2O_3$ (80-200 nm) film on an Al disk after 5× thermal cycling.

To identify any obvious contamination issues, the unground surface of the samples was examined using energy dispersive X-ray spectroscopy (EDS). The spectrum is shown in FIG. 10. The only elements found are Bi and Au (Au is conductive surface coating needed for field emission SEM (FESEM) imaging) in the EDS before thermal cycling, FIG. 11 shows the spectrum after 1× thermal cycling and FIG. 12 shows the spectrum after 5× thermal cycling. There are no surface impurities identified from processing or firing. However, for the samples that underwent 5× thermal cycling (FIG. 12) additional impurities and Al can be seen. It was concluded that the Al from the disk is undergoing evaporative losses due to repeated exposure at 600° C. during 5× thermal cycling and partially depositing back on the target surface.

Figure 13B:
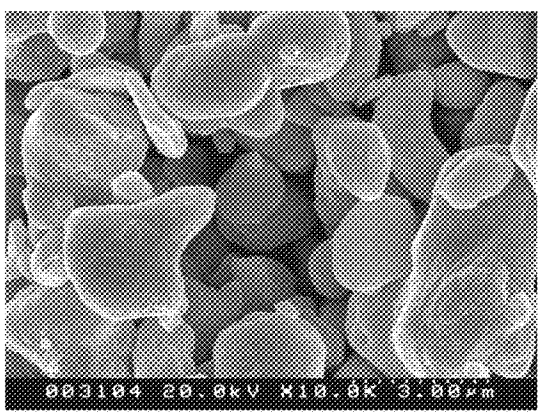
FIGS. 13A-13C are SEM micrographs of $Bi_2O_3$ (<4 micron) on Al disk where
Figure 13C:
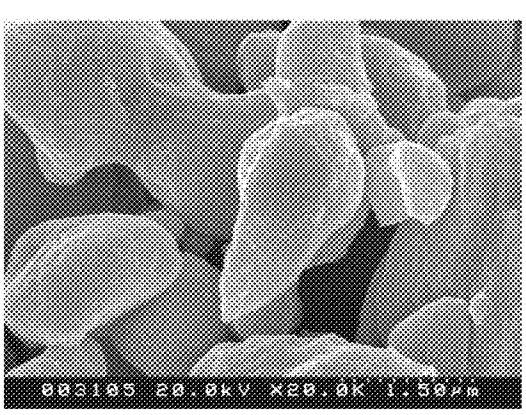
Figure 13A:
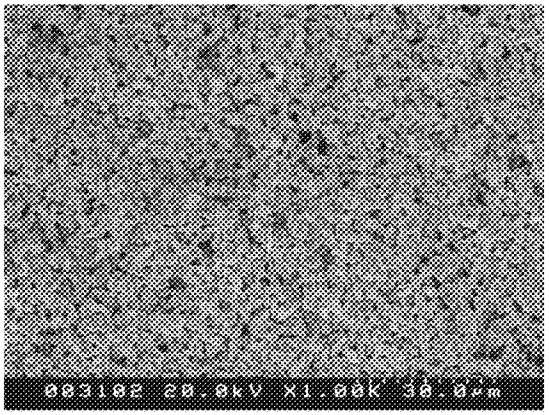
Figure 14:
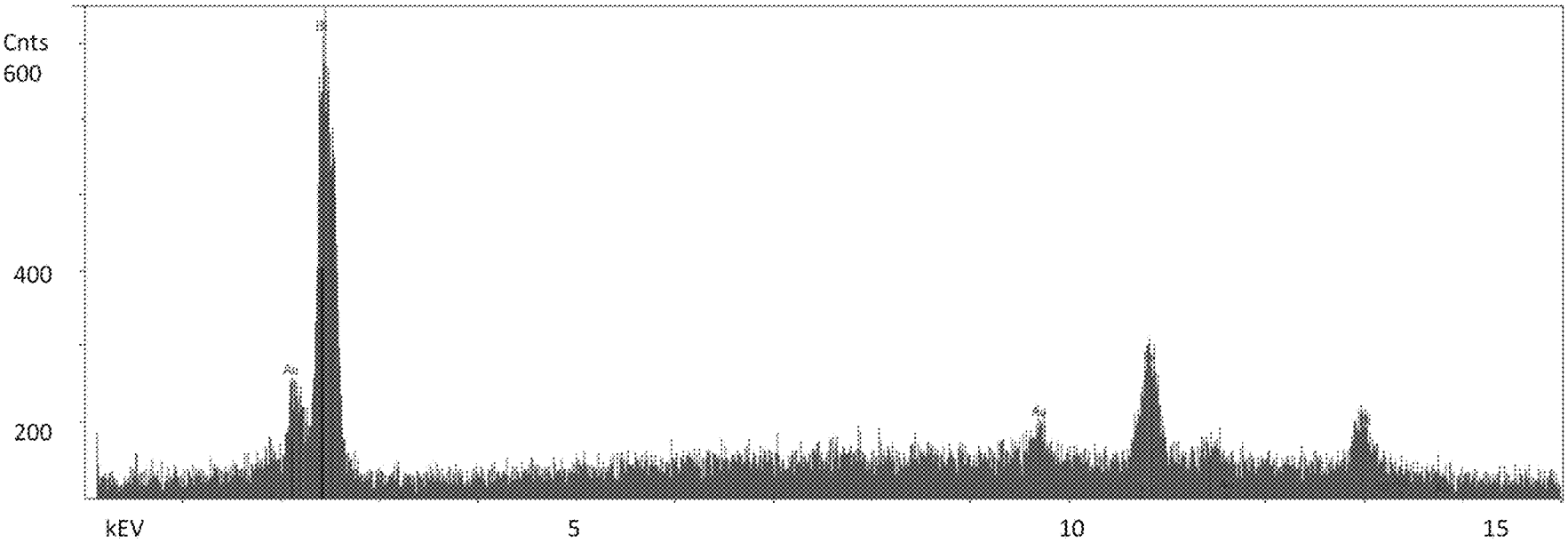
FIG. 14 shows an EDS scan of the $Bi_2O_3$ (<4 micron) on Ti sheet after 1× thermal cycling.

FIG. 13A-13C show the SEM micrographs of $Bi_2O_3$ (with particle size <4 μm) deposited on Al disk after 1× thermal cycling at 1×, 10× and 20× magnification. The EDS (FIG. 14) confirms that there is only Bismuth on the surface and Al was not lost due to evaporation during 1× thermal cycling.

Figure 15A:
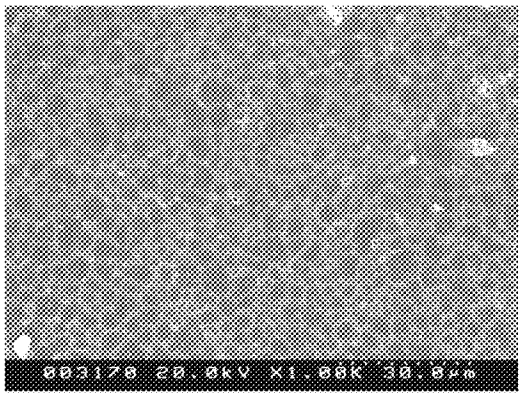
FIGS. 15A-15C are SEM micrographs of nano-porous $Bi_2O_3$ (80-200 nm) pressed into pellets and fired at 650° C. for 4 h where
Figure 15B:
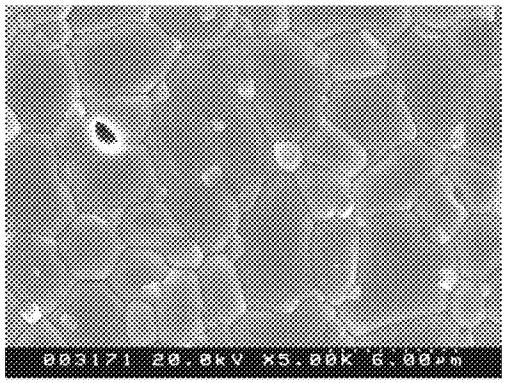
Figure 15C:
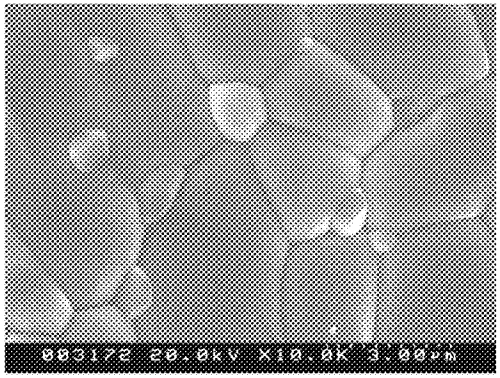
Figure 16:
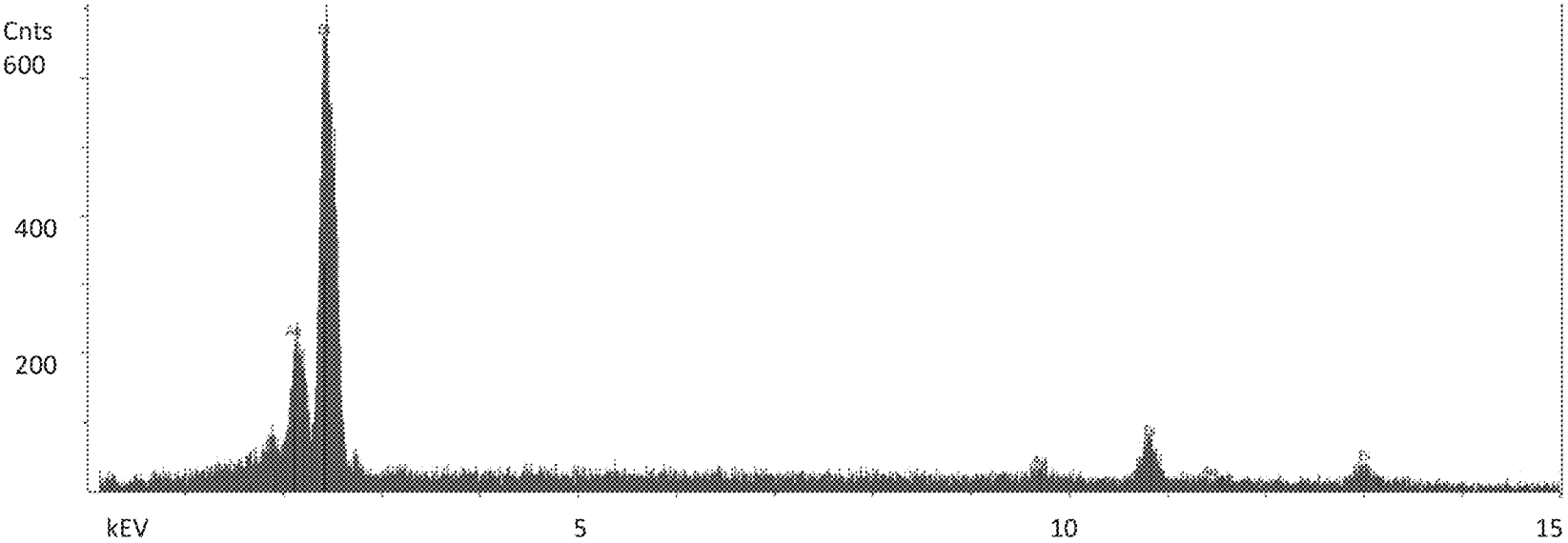
FIG. 16 shows an EDS scan of the same pellet shown in FIGS. 15A-15C.

The SEM micrographs of porous $Bi_2O_3$ pellets in FIGS. 15A-C show the crystalline structure of $Bi_2O_3$ pellet at 1×, 10× and 20× magnification. The EDS for $Bi_2O_3$ pellets (FIG. 16) does not show any contamination from processing. The Au is from the conductive Au coating needed for FESEM imaging of an electrically insulating sample. Therefore, only Bismuth is present. These pellets, after they are pressed, were ramped from room temperature to 650° C. in 4 hours and were held at 650° C. for 4 hours before being cooled down to room temperature.

Figure 17A:
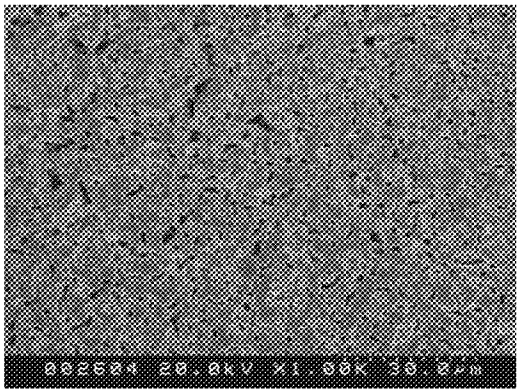
FIGS. 17A-17F are SEM micrographs of the nano-porous $Bi_2O_3$ (80-200 nm) on Ti sheet where
Figure 17B:
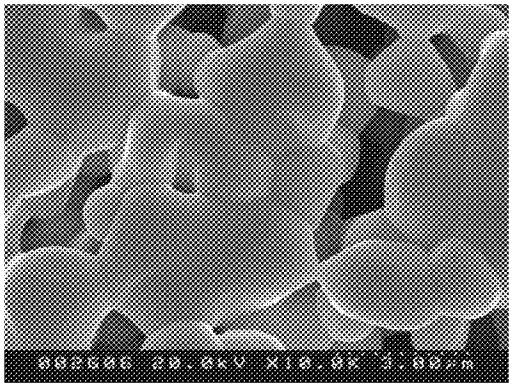
Figure 17C:
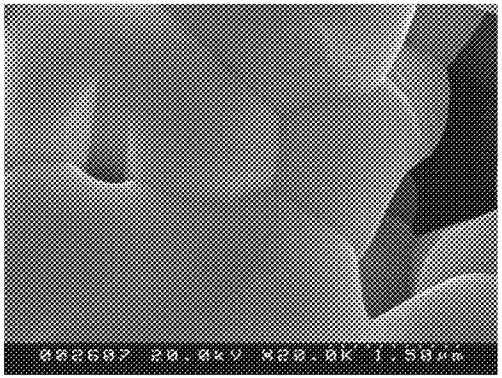
Figure 17D:
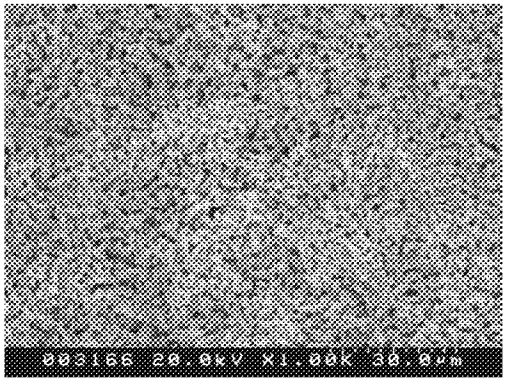
Figure 17E:
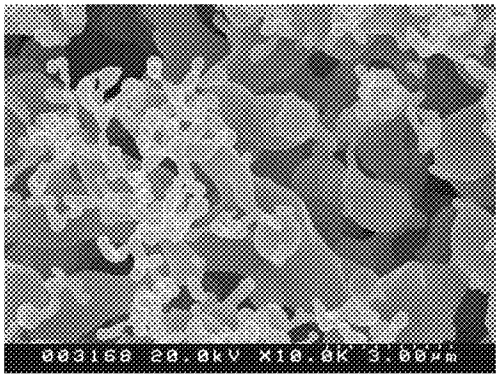
Figure 17F:
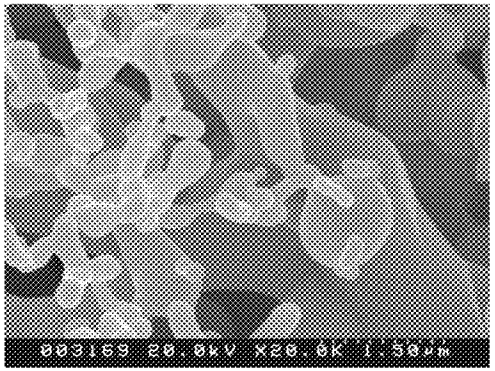
Figure 18:
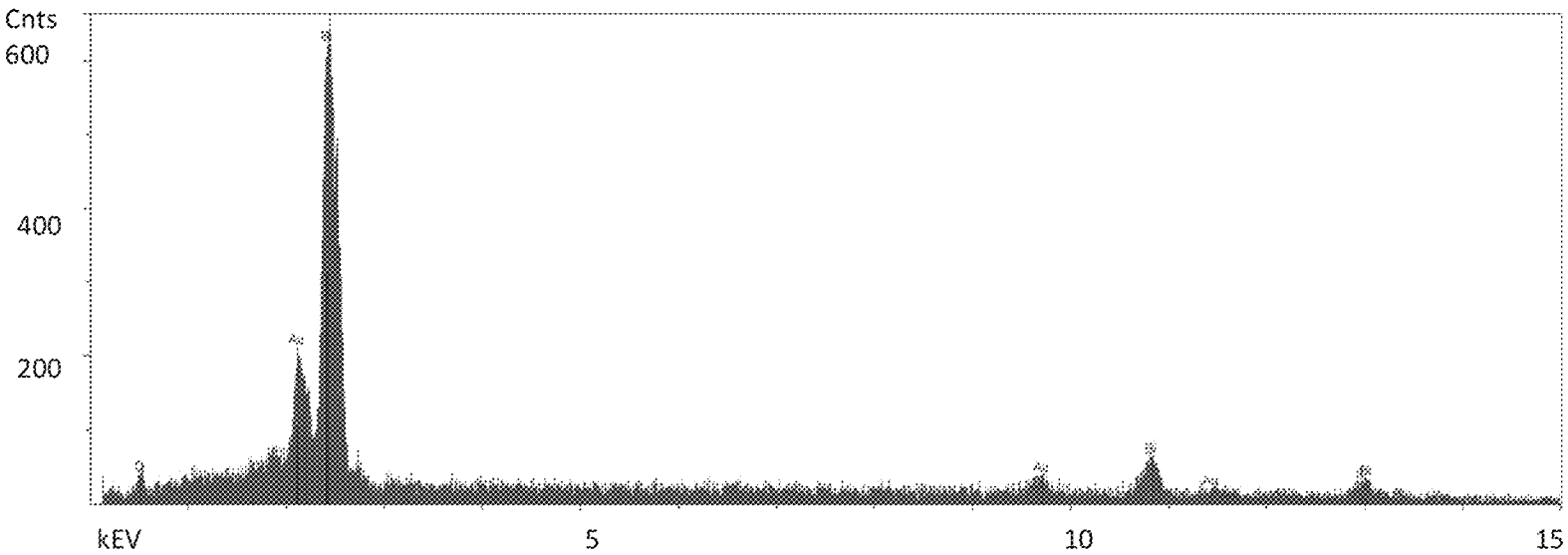
FIG. 18 shows an EDS scan of the nano-porous $Bi_2O_3$ (80-200 nm) on Ti sheet after 5× thermal cycling.

The SEM micrographs of the nanoscale $Bi_2O_3$ deposited on Ti sheet are shown in FIGS. 17A-17F. The images in FIGS. 17A-17C show the particle structure of $Bi_2O_3$ on Ti substrates after deposition and firing of the samples at 800° C. at 1×, 10× and 20× magnification. FIG. 17 D-F shows the micrographs after 5× thermal cycling. It is interesting to note particle coalescence, faceted grain growth and grain boundaries (FIGS. 17B and 17C). Also noted are new small crystal structures at 10 KX and 20 KX magnification (FIGS. 17E and 17F). Unlike Al, Ti can withstand exposure to repeated high temperatures (~600° C.) so the particle morphology of $Bi_2O_3$ films are still retained. The newly formed small crystals on top of the target film appear to be condensed Bismuth metal, based on the scattering intensity from metallic (Bi) and insulating surfaces ($Bi_2O_3$). Further, from the EDS analysis (FIG. 18) it is evident that it is the bismuth metal as no other metal peaks are seen.

Figure 19A:
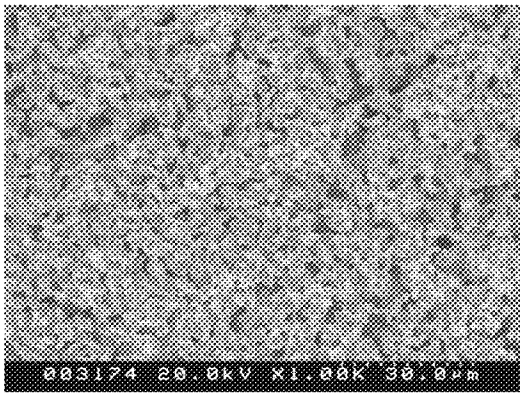
FIGS. 19A-19C are SEM micrographs of $Bi_2O_3$ (<4 micron) on Ti sheets where
Figure 19B:
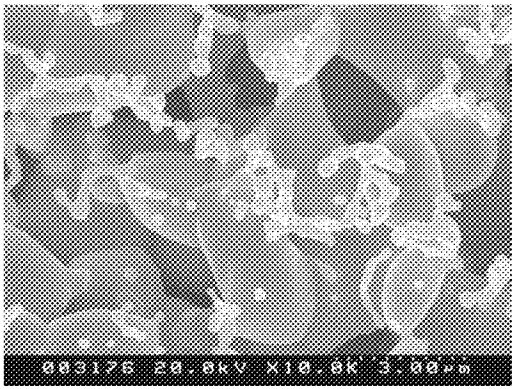
Figure 19C:
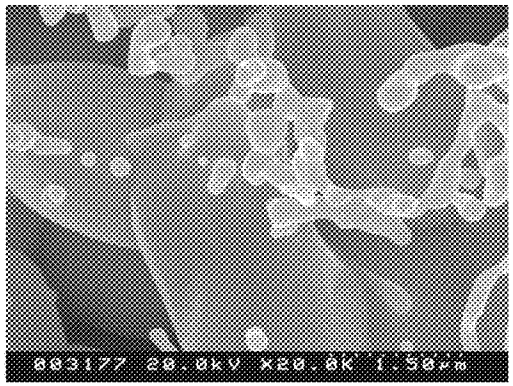
Figure 20:
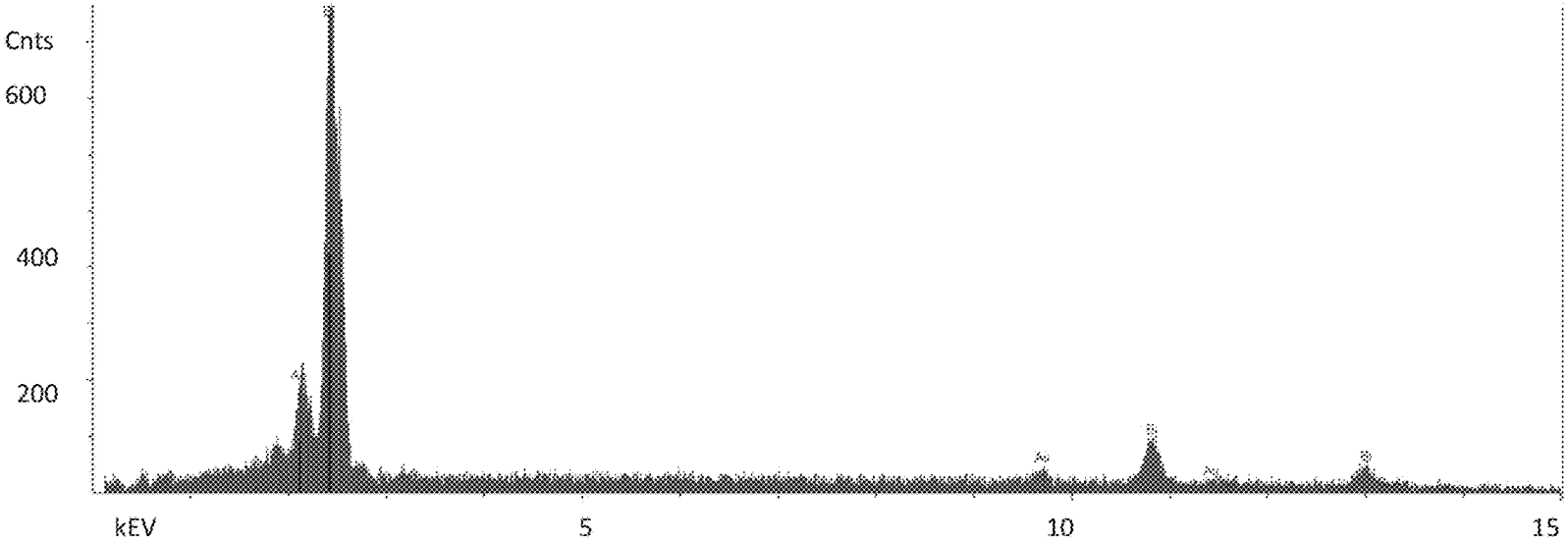
FIG. 20 shows an EDS scan of the $Bi_2O_3$ (<4 micron) on Ti sheet shown in FIGS. 19A-19C after 5× thermal cycling.

SEM analysis was also performed on the $Bi_2O_3$ with <4-micron particle size on Ti sheets. The micrographs are shown in FIGS. 19A-19C. Similar observations of small crystal formation was noted after 5× thermal cycles at 10 KX and 20 KX magnification (FIGS. 19B and 19C). The EDS for the targets film made from <4-micron particle size $Bi_2O_3$ is shown in FIG. 20.

Figure 21A:
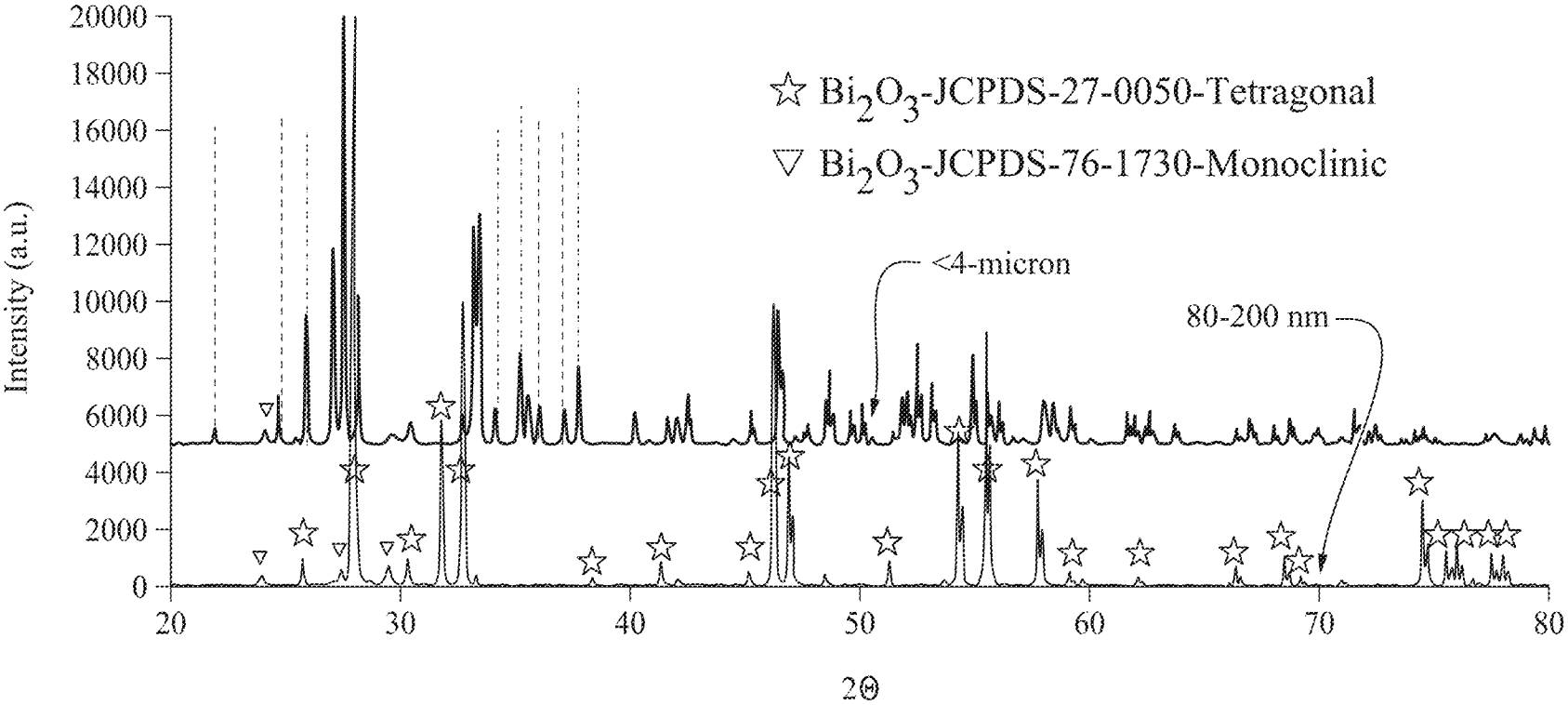
FIG. 21A is an XRD of $Bi_2O_3$ powders with 80-200 nm particle size and <4-micron particle size.

XRD Analysis To understand the phase transformations with change in temperature and identify the phase of the starting materials, X-ray Diffraction (XRD) analysis was performed on the two grades of $Bi_2O_3$ powders of different size specifications as well as on the $Bi_2O_3$ film on Ti substrate processed at 800° C. for 30 minutes. In addition, both room temperature (RT) XRD and high temperature XRD was carried out on fired $Bi_2O_3$ films (using particle size 80-200 nm) that were deposited and fired at 600° C. for 30 minutes. The samples were heated at a rate of 5° C./min, held at targeted temperatures for 15 minutes, and then heated to the next higher temperature. FIG. 21A shows the XRD pattern for the starting materials indexed to the Joint Committee on Powder Diffraction Standards (JCPDS).

Figure 21B:
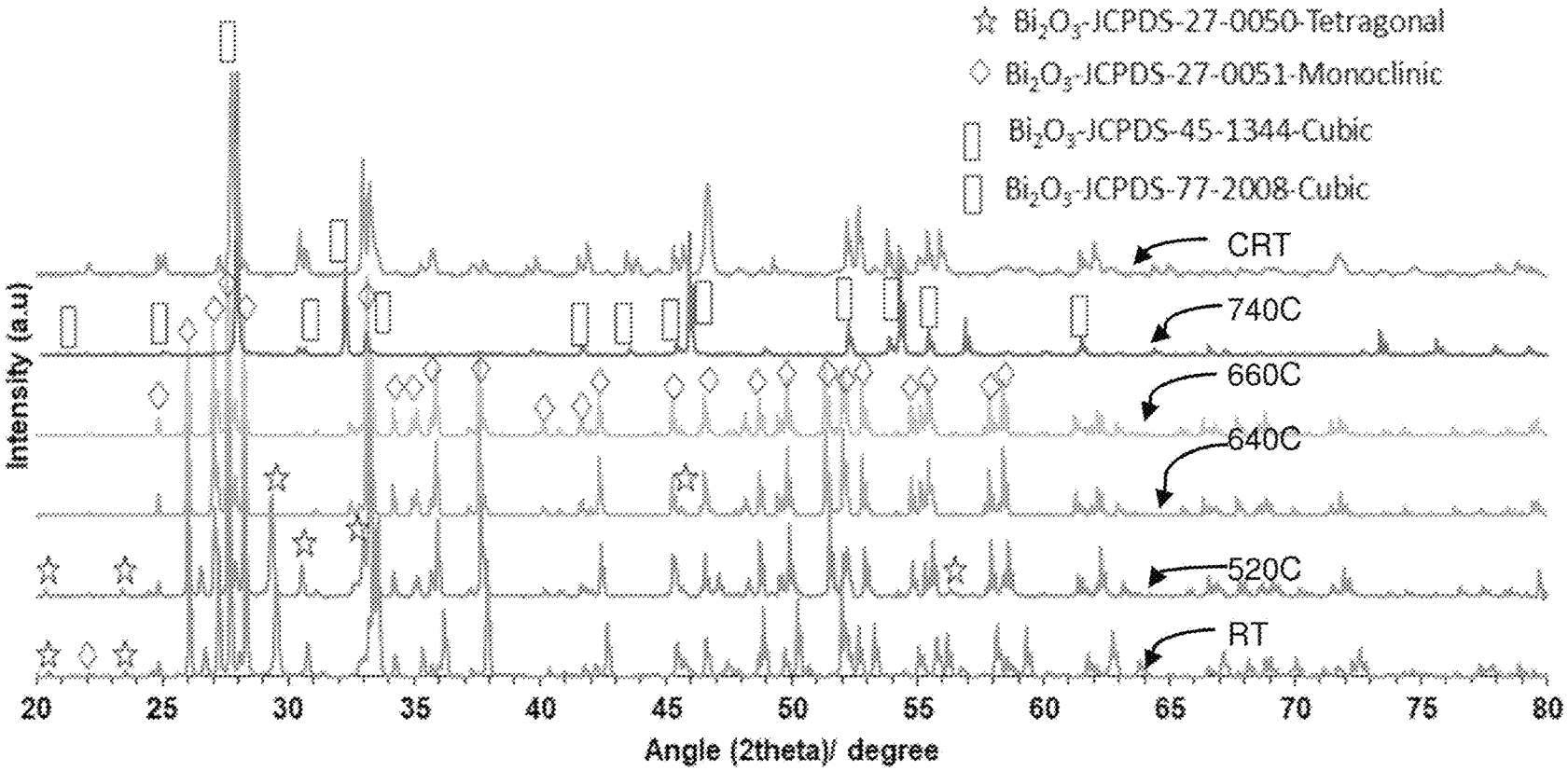
FIG. 21B shows XRD scans of the $Bi_2O_3$ film on Ti substrate at different temperatures, initially fired at 600° C. for 30 min after coating using the doctor blade technique.

The nanoscale $Bi_2O_3$ powder (80-200 nm) was predominantly a tetragonal phase that typically does not exist at RT. It was presumed to be made by a special process, either rapid or slow cooling to stabilize this phase. The micron sized $Bi_2O_3$ powder was monoclinic (FIG. 21A) The high temperature XRD on the nano-scale $Bi_2O_3$ reveals the following (FIG. 21B):

Starting powder is tetragonal,

The resulting film from initial processing at 600° C. and cooling to room temperature has co-existing tetragonal and monoclinic phases.

Heating to 520° C. showed presence of mixed tetragonal and monoclinic phases.

Heating to 640 and 660° C. showed only a monoclinic phase.

At 740° C. the monoclinic material transformed to cubic phase.

Cooling to room temperature resulted in a mixed cubic and monoclinic phase.

Further, initial processing of the nanoscale $Bi_2O_3$ powders into a film at 800° C. and cooling to room temperature, resulted in a cubic phase. From the phase diagram of $Bi_2O_3$, ("Improved carrier mobility and bandgap tuning of zinc doped bismuth oxide", https://www.researchgate.net/publication/269287084_Improved_carrier_mobility_and_bandgap_tuning_of_zinc_doped_bismuth_oxide. Accessed December 2019) it can be concluded that if the starting material is monoclinic phase, by varying heating and cooling rates intermediate phases can be avoided and the material goes from monoclinic at room temperature to cubic phase at 729° C. Therefore, the monoclinic $Bi_2O_3$ powders with different particle sizes was preferred to avoid multiple phase transformations and any resulting crystal lattice volume expansion/contraction issues that could impact target robustness.

Figure 22A:
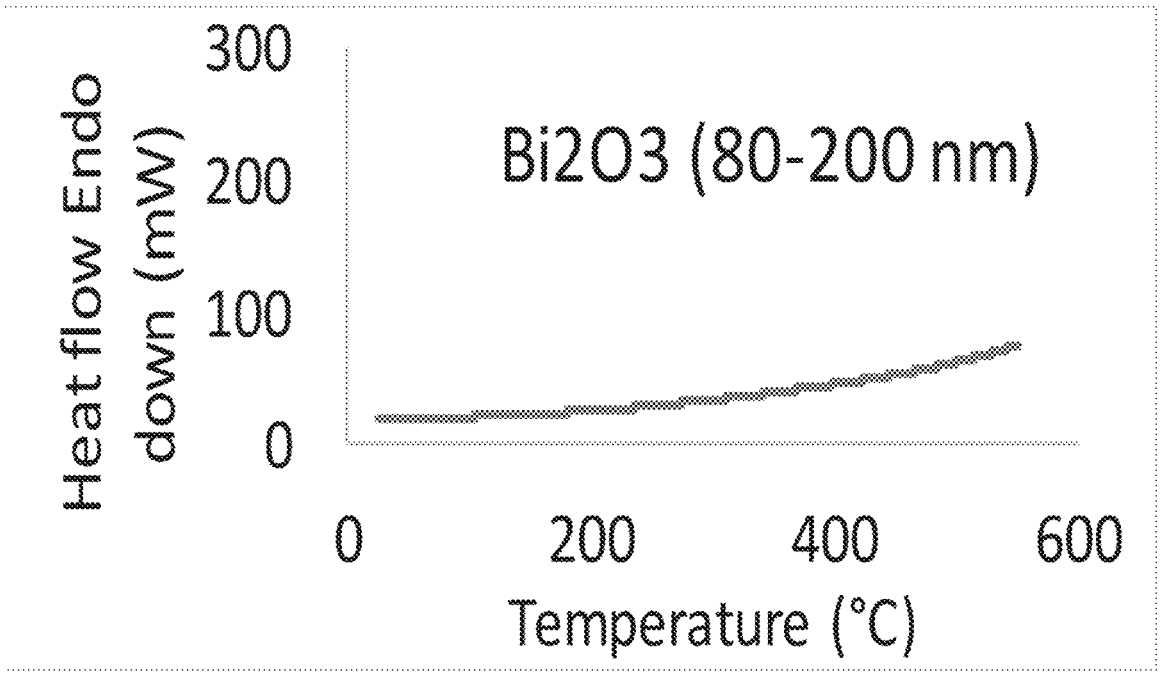
FIGS. 22A and 22B are DSC thermograms of $Bi_2O_3$ powders where
Figure 22B:
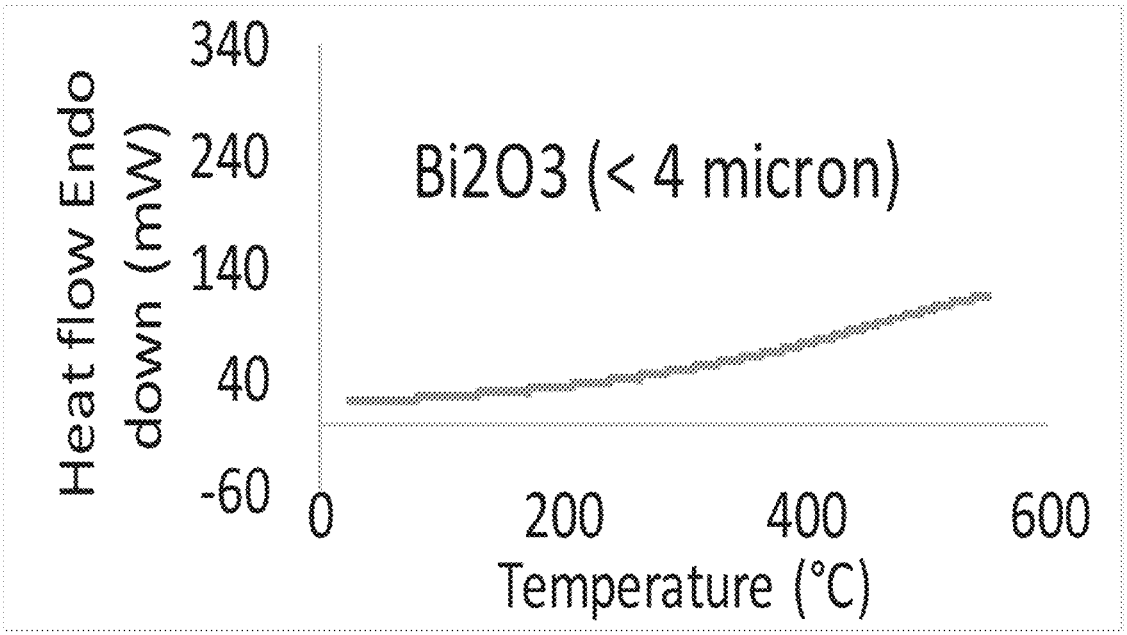

DSC Analysis—The onset of endothermic changes of different grades of the $Bi_2O_3$ starting material was determined by DSC. Thermal scans were performed from 20° C. to 550° C. at a rate of 5° C. per minute to identify the occurrence of any phase transformations. About 5-15 mg of sample was placed in an aluminum pan and sealed. The sample pan was heated against an empty pan as a reference. FIGS. 22A and 22B show the DSC thermograms of $Bi_2O_3$ powders with two different particle sizes. It is clear from the thermographs that there is no heat release or heat absorption in the tested temperature range confirming that the starting material will remain in the same structural state (monoclinic or tetragonal) till 550° C. This result agrees with the observations made from the XRD analysis.

Evaluating Bismuth Oxide Targets with Lithium-6 Beam at ATLAS

A total of four targets supported on 303SS were delivered to Argonne for beam line tests. In order to accommodate the testing, substrates as described herein were designed and fabricated for compatibility with the beamline chamber. For the Li beam experiments the target (substrate) was ⅞ "diameter and ¼" thick disks with 6 holes in the back to support tungsten rods as a sample holder. The four target samples delivered to Argonne had a density for the $Bi_2O_3$ films ranging from 4.03-4.46 mg/cm$^2$.

Figure 23A:
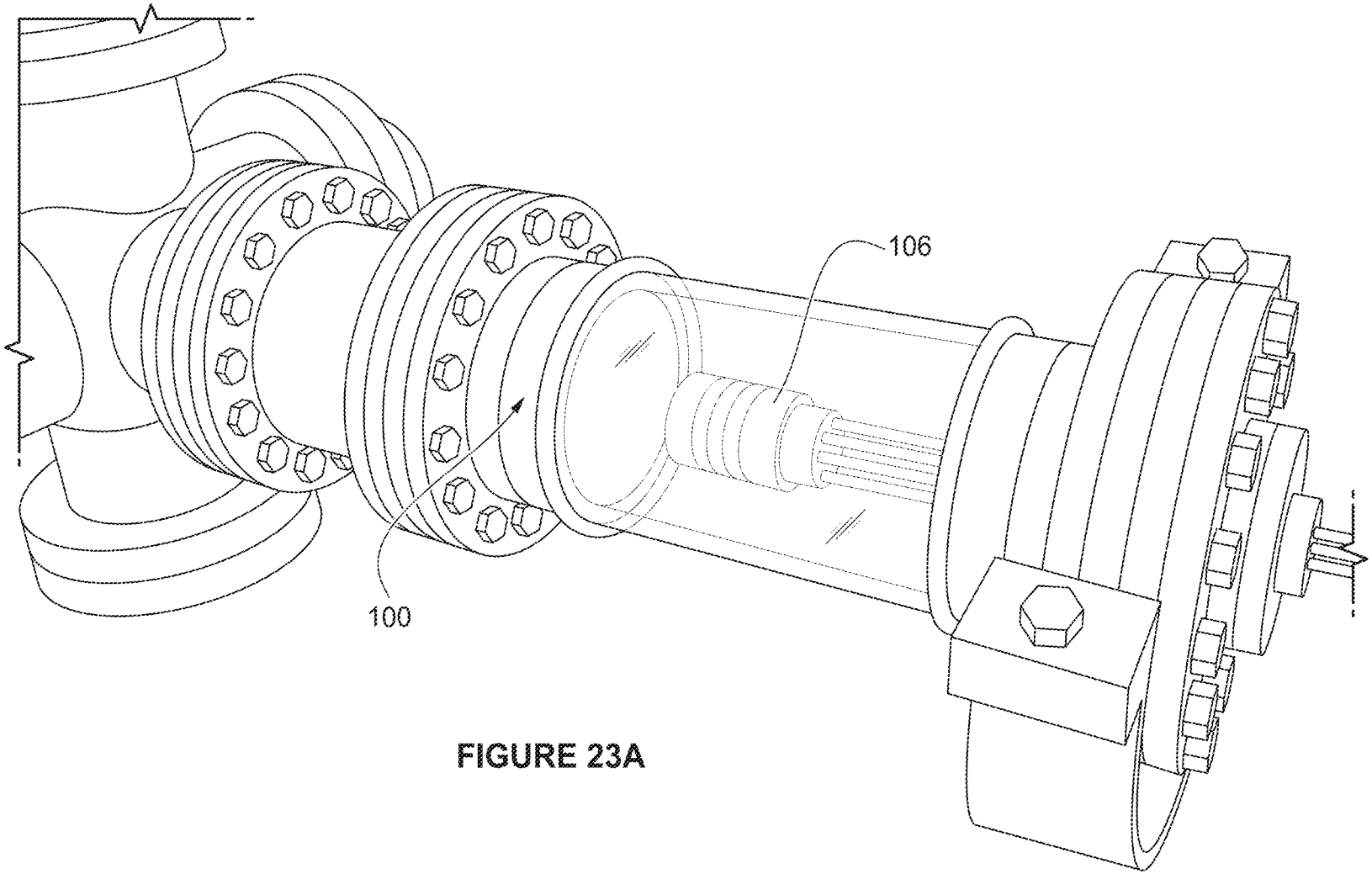
FIG. 23A shows a system for directing a Li beam on a $Bi_2O_3$ target.
Figure 23B:
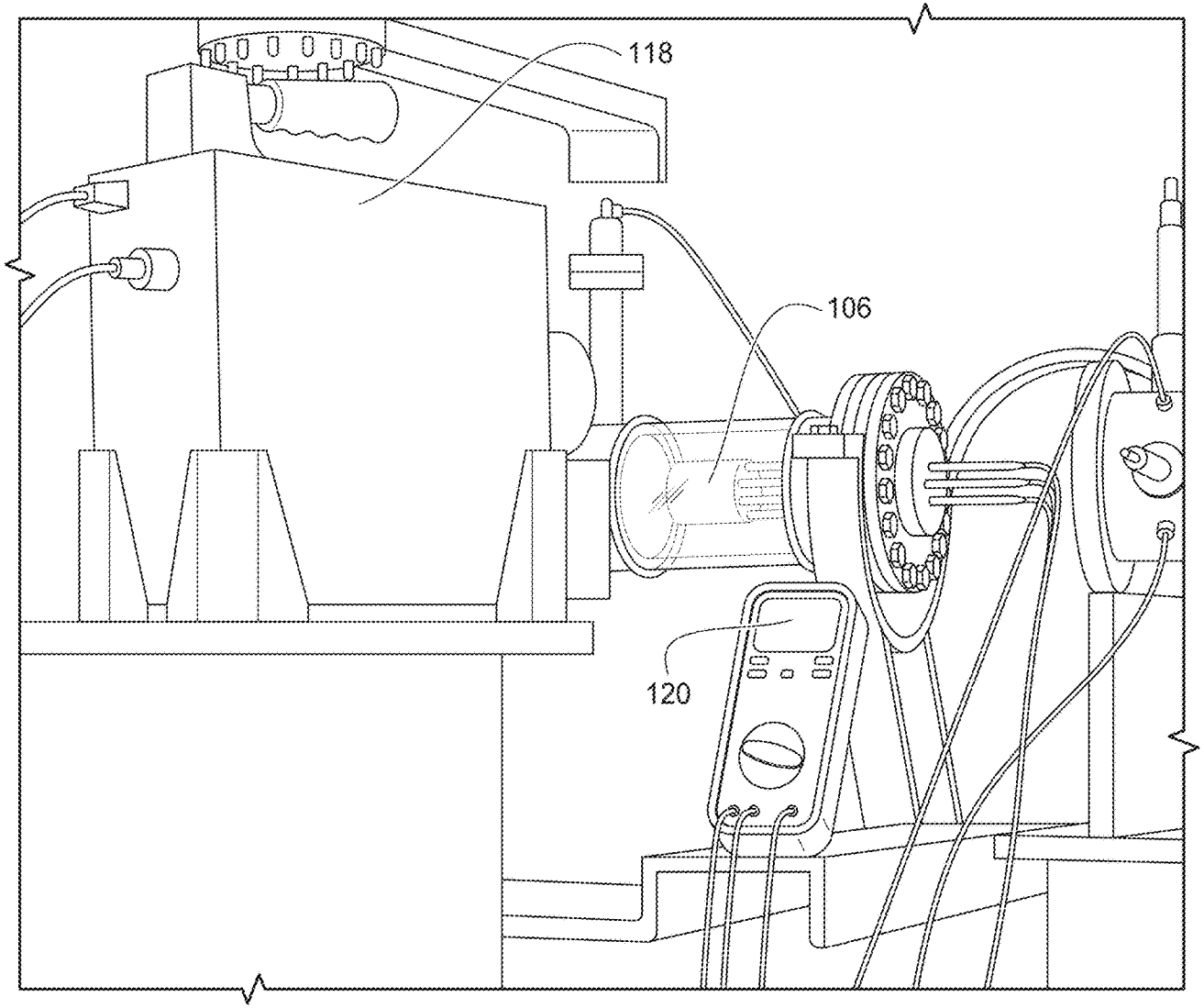
FIG. 23B shows a portable HPGe detector and thermocouple placed adjacent to the system of FIG. 23A.

A total of three runs were conducted to evaluate $Bi_2O_3$ targets with $^6$Li beam at ATLAS. All the runs were performed using 49 MeV $^6$Li beam on $Bi_2O_3$ targets on ¼" thick 303SS backings. The targets were placed within in a neutron shielded vacuum container (chamber) 104 separated from the beamline vacuum by a 25-micron thick Ti window 102 as shown in FIGS. 23A and 23B. A $^6$Li beam with 49 MeV after passing through 25 μm thick Ti window 102 irradiated the $Bi_2O_3$ target 106 (FIG. 23A). In order to measure the gamma rays for identification of the isotopes produced and the temperature of the $Bi_2O_3$ target, a portable HPGe detector 118 and thermocouple and temperature meter 120 were placed adjacent to the target (FIG. 23B). The targets were bolted to the front face of a heater element. A thermocouple was attached to the 303SS backings of the $Bi_2O_3$ targets. Based on readings from this thermocouple, the heater raised the targets up to slightly more than 700° C.

The heater (not shown) and targets 106 were mounted in a 4" optical density (OD) Pyrex glass tube with 6" OD ConFlat flanges at each end (FIG. 23A). The target/heater assembly was pumped to ~1 E-6 mbar (7.5×10−6 torr) using a multi-stage roots pump behind a turbo-molecular pump. The exhaust gas was passed through a mineral oil bubbler to capture any released $^{211}$Rn since radon gas has a high solubility in mineral oil. Because of the very low base pressure in the target/heater section there was essentially no bubbling seen in the oil.

Figure 24:
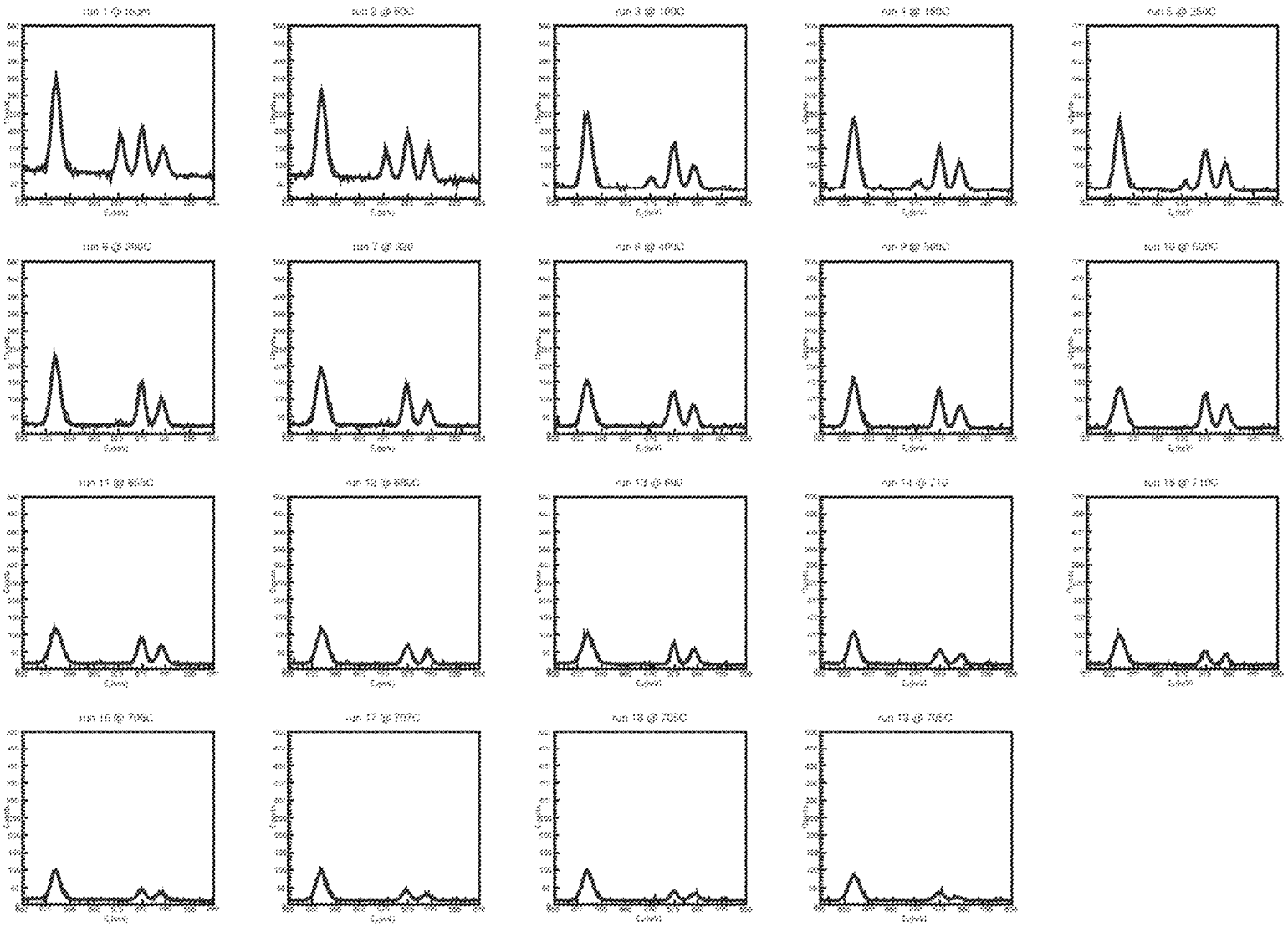
FIG. 24 shows multiple graphs of gamma ray strengths of $^{211}$Rn, Copper-61 and Zinc-63 produced vs time at various temperatures of the target from room temperature to over 700° C.
Figure 25:
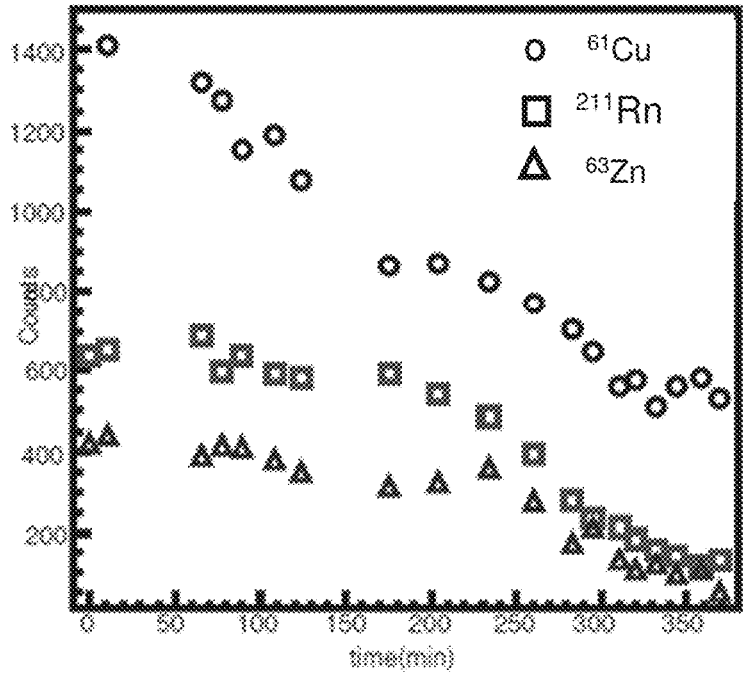
FIG. 25 is a graph showing the yields of the $^{61}$Cu gamma (circles) and the $^{211}$Rn 674 keV and $^{211}$Rn 678 keV gamma (squares and triangles) vs time. Decay of $^{211}$Rn and $^{61}$Cu analyzed by ROOT.

A series of 3 heat cycle tests of the $Bi_2O_3$ targets were conducted. In a first run, the target was irradiated for a short time with the $^6$Li beam at low current (2.7 pnA and 12 pnA) and at 19 pnA to produce $^{211}$Rn in the $Bi_2O_3$ target. FIG. 24 is a composite of 19 graphs showing the gamma ray strengths (counts v E/keV) of the produced $^{211}$Rn vs time at different target temperatures (RT, 50 C, 100 C, 150 C, 250 C, 300 C, 320 C, 400 C, 500 C, 600 C, 655 C, 680 C, 690 C, and 6 runs between 700 C and 710 C) as the temperature was slowly increased from room temperature to over 700° C.). Two characteristic gamma rays from $^{211}$Rn are at 674 and 678 keV ($t_{1/2}$=14 hours). A nearby gamma peak of $^{61}$Cu is also plotted. This peak is from $^{61}$Cu decay ($t_{1/2}$=3.3 hours). The $^{61}$Cu was produced via a lithium induced reaction in the SS backing: $^{54}$Fe($^6$Li,n)$^{61}$Cu reaction. This peak served as a convenient time dependent and geometry-independent normalization of the $^{211}$Rn yield and release curve. A fourth peak, seen near these 3 peaks is the 669 keV gamma ray from $^{63}$Zn ($t_{1/2}$=38 minutes) produced via the $^{58}$Ni($^6$Li,n)$^{63}$Ga>$^{63}$Zn reaction. FIG. 25 shows the evolution of these 4 closely spaced gamma rays vs time and temperature following the short irradiation of the bismuth target on the 303SS backing.

Figure 26:
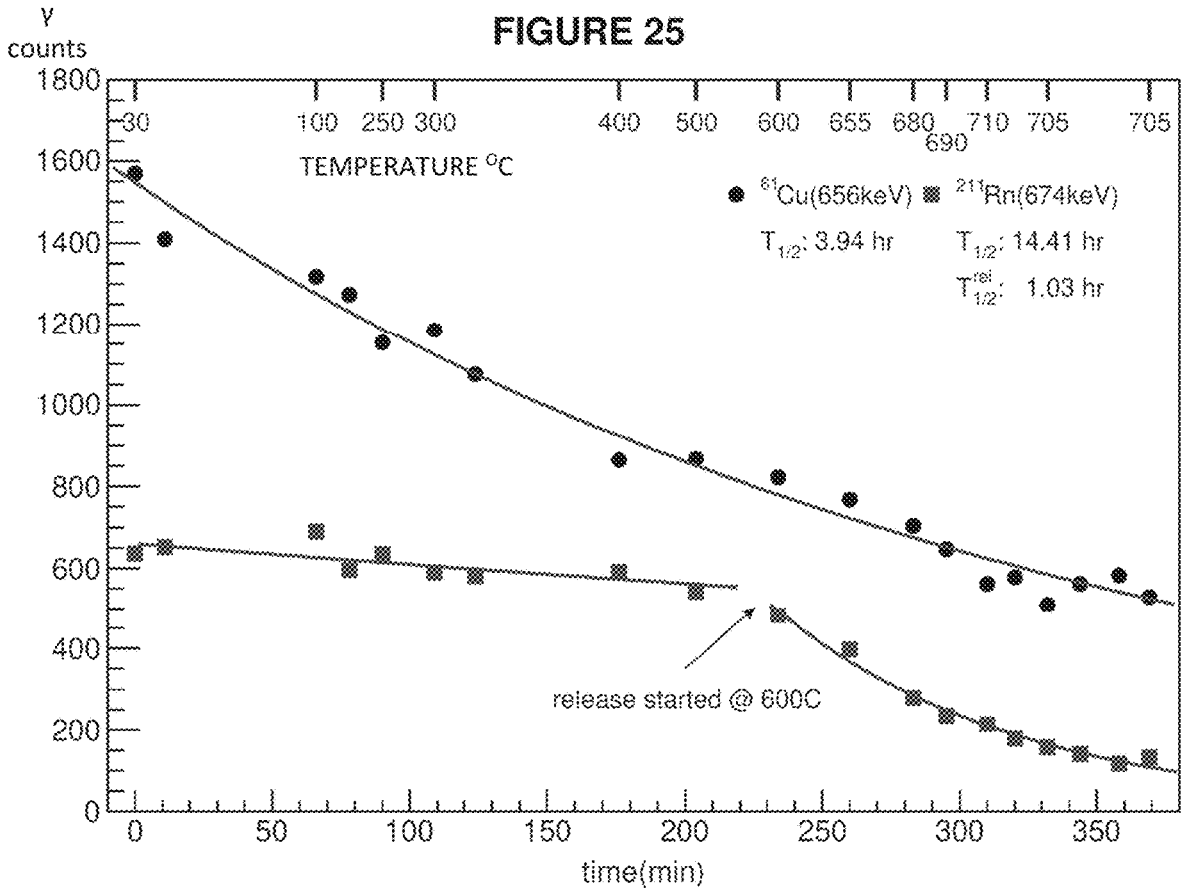
FIG. 26 is a graph showing the yields of the $^{61}$Cu gamma and the $^{211}$Rn 674 keV gamma vs time and temperature.
Figure 27:
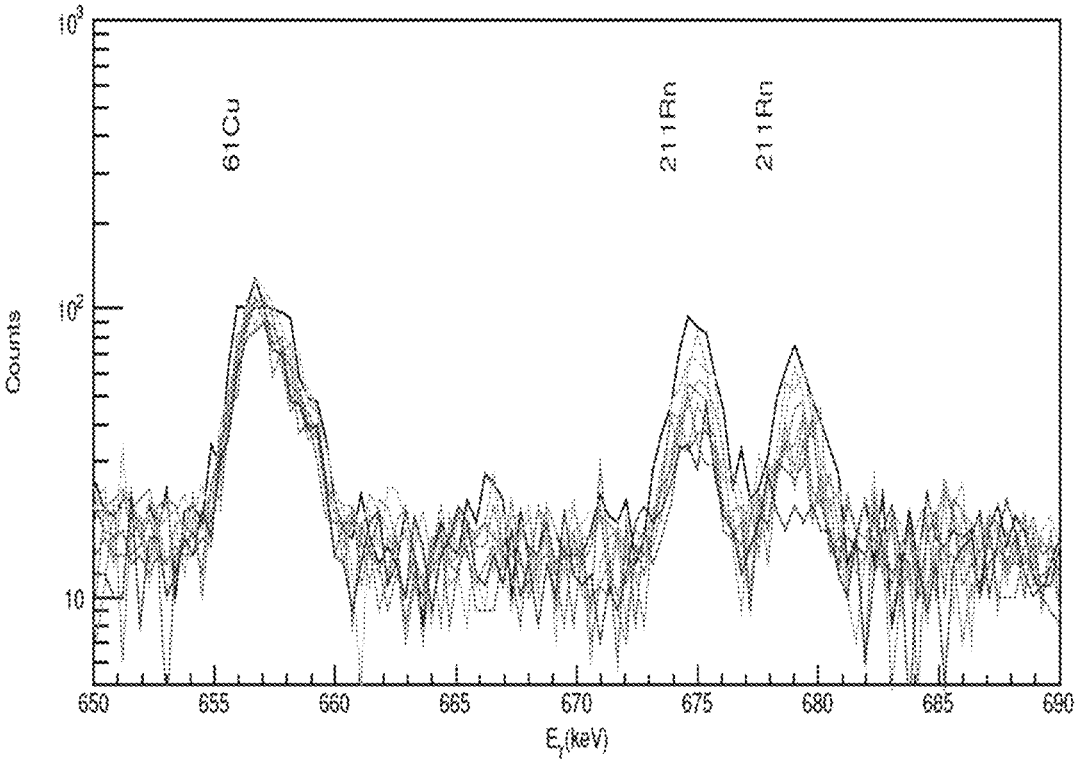
FIG. 27 illustrates selected spectra after a first irradiation run in the energy range 650-690 keV using the peak of $^{61}$Cu with 3.3 hr half-life as a reference.
Figure 28:
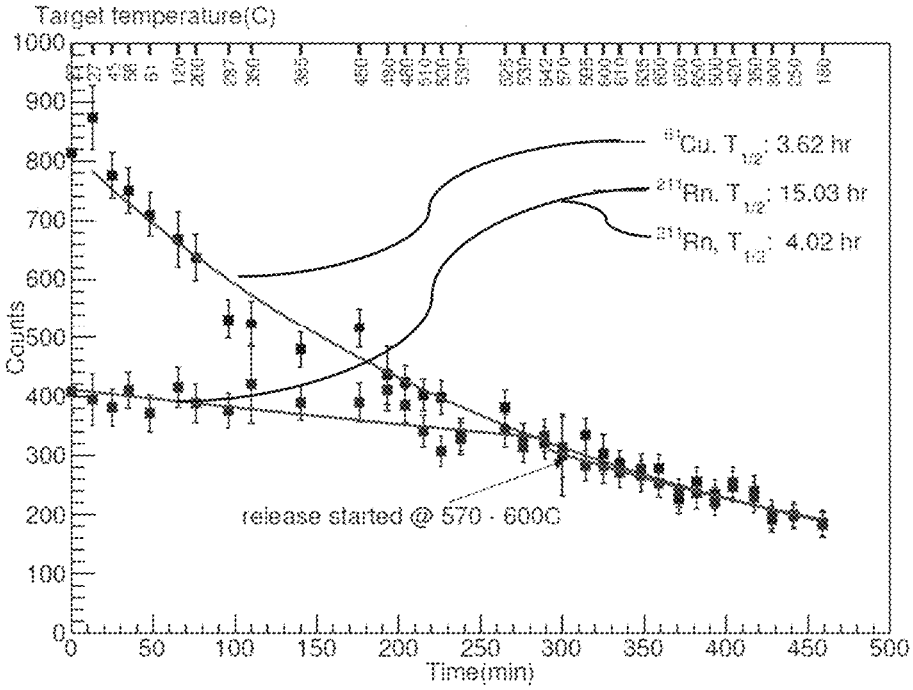
FIG. 28 shows the decay of $^{211}$Rn and $^{61}$Cu analyzed by GF3 of RADWARE showing the number of counts vs Elapse time and target temperature.
Figure 29:
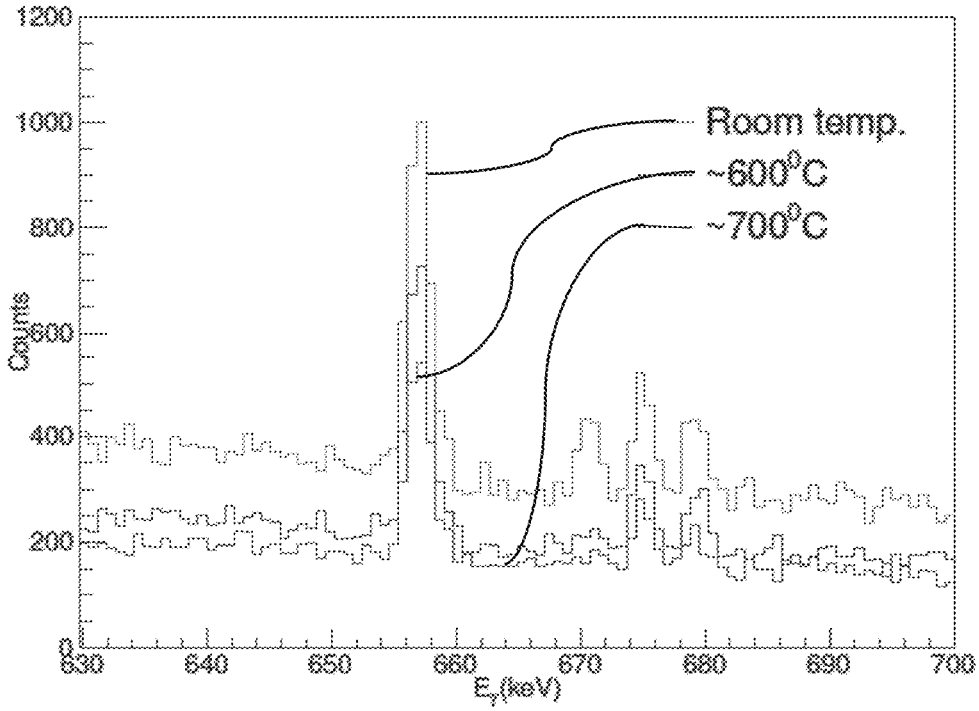
FIG. 29 shows the y spectra after second irradiation.
Figure 30:
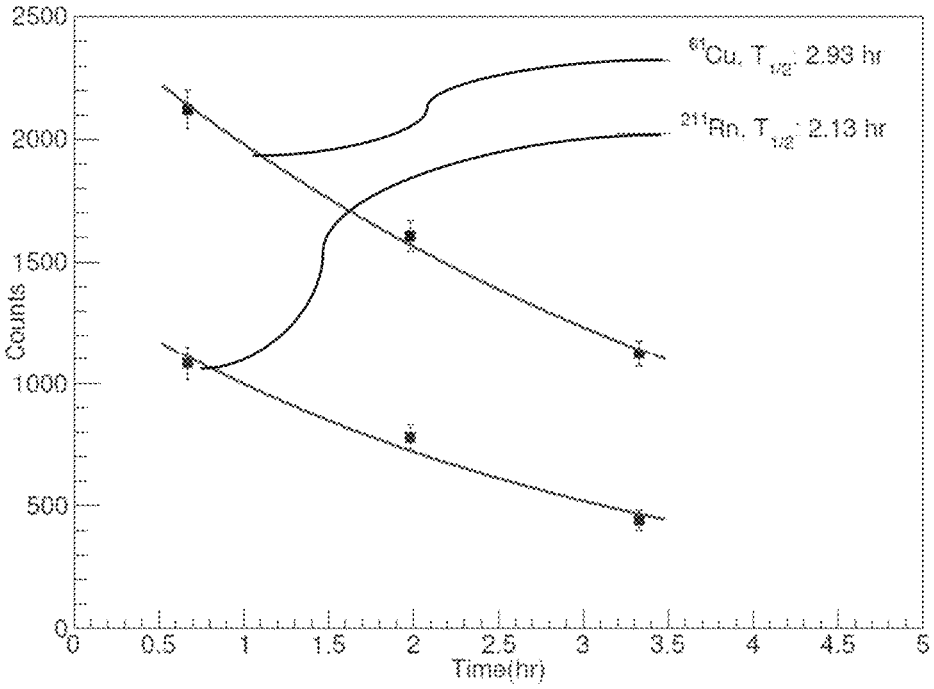
FIG. 30 shows decay curves 1st point for $^{61}$Cu and $^{211}$Rn.

The yields of the $^{61}$Cu gamma and the $^{211}$Rn 674 keV gamma vs time and temperature are shown in FIG. 26. The $^{61}$Cu gamma shows a decay curve very close to its known half-life indicating it is produced near the end of the range of the $^6$Li beam in the 303SS and it does not diffuse from the 303SS. However, the yield of the $^{211}$Rn gamma rays first follows its 14-hour half-life but begins to decrease much more rapidly beginning at ~500° C. While this appeared to be a positive result indicating nearly complete release of $^{211}$Rn from the $Bi_2O_3$ target in the temperature range between 500 and 700° C., a re-irradiation of the target did not produce any new $^{211}$Rn. It was discovered that the bismuth was being evaporated from the oxide target in this temperature range even though the vapor pressure is low at these temperatures. However, it was also discovered that the oxide target had delaminated from the substrate. Further, it was discovered that a wire inside the target/heater vacuum chamber adjacent the $Bi_2O_3$ target was coated with Bi metal. Also, when the oxide target was exposed to temperatures in excess of over 700° C. some bismuth had evaporated, presumably due to a reducing action of the iron in the SS backing on the oxide. Still further, at temperatures of the target above 500° C. the Pyrex tube was found to be coated with bismuth metal. However, based on re-irradiation it was demonstrated that the amount of bismuth mass loss was not significant.

To determine the magnitude of this reduction effect, a second thermal cycling of a $Bi_2O_3$ target on a SS backing was carried out without the beam, but with a Pyrex plate mounted near the bismuth oxide target. This confirmed that in fact bismuth metal was released from the target at about 500° C. However, the process was apparently self-limiting; i.e., as the iron oxide layer built up, the reducing reaction ceased since metallic iron was no longer in contact with the $Bi_2O_3$.

To confirm this hypothesis a second thermal cycle with the $^6$Li beam was carried out. The procedure during the second beam run comprising 3 beam irradiations like the first procedure described above. Beam currents were 2 pnA, 12 pnA and 19 pnA for the three irradiations. The first irradiation was followed by a thermal cycle up to 700° C. with results similar to those of the first run. Then to determine how much bismuth had left the target due to the reduction reaction of the iron on the oxide, a second irradiation was done. The result was that the yield from the second irradiation was consistent with no bismuth being lost from the target even though there was obvious coating of the glass tube with bismuth. The yield versus time and temperature of the $^{211}$Rn gamma rays was very similar in the second thermal cycle as in the first thermal cycle of this second run with the $^6$Li beam, and both of these were similar to the corresponding curves for the first thermal cycle with the beam. As shown in FIGS. 27-30 >~60% of the Rn was released showing an effective half-life of ~2 hours. However, the target delaminated at the beginning of a third thermal cycle. The Rn yield in the third irradiation was good, but there was no release of Rn during the third thermal cycle. This was explained by observing that the $Bi_2O_3$ layer had delaminated into chips which fell to the bottom of the Pyrex tube. The resulting gamma yields were not affected as they were still in the field of view of the gamma detector.

Further, a quick HSC calculation on the reaction of a metal M with $Bi_2O_3$ to form M-oxide and Bi(g) was made. Some selected results for the equilibrium vapor pressure of Bi(g) (in torr) from the reaction of $Bi_2O_3$ with several metals at 500° C. are given below in Table 5. The vapor pressure of Bi(g) for the Fe+$Bi_2O_3$ system is quite high. This explains why Bi is vaporizing. At 500° C., vaporization of Bi decreases (in sequence) as the base metal (Ni, Cu, Pt, Ag, and Au) is changed.

TABLE 5

Equilibrium Vapor Pressure from HSC Calculations

| Base Metal | Balanced reacting | T (° C.) | $P_{bi}$ (torr) |
|---|---|---|---|
| Fe | 1.5Fe + 0.5Bi2O3 = 1.5 FeO + Bi(g) | 500 | 4.8E+04 |
| Ni | 1.5Ni + 0.5Bi2O3 = 1.5NiO + Bi(g) | 500 | 1.4E+00 |
| Cu | 3Cu + 0.5Bi2O3 = 1.5Cu2O + Bi(g) | 500 | 2.7E−06 |
| Ag | 3Ag + 0.5Bi2O3 = 0.5Au2O3 + Bi(g) | 500 | 1.4E−19 |
| Au | Au + 0.5Bi2O3 = 0.5Au2O3 + Bi(g) | 500 | 1.7E−24 |
| Pt | 0.75Pt + 0.5Bi2O3 = 0.75PtO2 + Bi(g) | 500 | 1.1E−17 |

While delamination occurred under certain conditions, these results indicate that a robust target for the production of $^{211}$At with a $^{211}$Rn/$^{211}$At generator can be produced when conditions are optimized. The methods and procedure do produce $^{211}$Rn with continuous release and capture in either a charcoal trap or mineral oil and this procedure will effectively increase the useable half-life of $^{211}$At from 7 hours to 14 hours.

Evaluation of $Bi_2O_3$ Target in the Alpha Beam Production of $^{211}$At

Targets were developed for evaluation in the alpha beam ($^4$He) line at the UPenn medical cyclotron facility. $Bi_2O_3$ coated Al disk targets were fabricated and delivered to the Division of Nuclear Medicine and Clinical Molecular Imaging, at the Perelman School of Medicine University of Pennsylvania to evaluate the performance of $Bi_2O_3$ targets in currently used methods to extract $^{211}$At.

Two irradiations were performed. Table 6 reports the comparison of production rate, thickness and density of Bi metal with $Bi_2O_3$ target after alpha beam testing. The weights of the targets were noted before and after irradiations. For $Bi_2O_3$ targets, oxygen in the targets resulted in co-production of Fluorine-18 (~50% of activity at end of beam line). A lower production rate was expected due to lower density of $Bi_2O_3$ compared to elemental bismuth. However, these results are in good agreement with the calculated yields expected based the density of $Bi_2O_3$.

TABLE 6

Summary of Alpha Beam Line Testing at UPenn Cyclotron Facility

| Target Material | Bi (m) | $Bi_2O_3$ |
|---|---|---|
| Production Rate (MBq/μA * min) | 11 | 7.7 |
| Thickness (μm) | 70 | 70 |
| Weight (mg) | 150 | 40 |
| Density (mg/cm$^2$) | 70 | 19.9 |

Although some discoloration of the targets was observed no loss of mass following irradiation was noted. While the production rate using the $Bi_2O_3$ target is reduced by ~30% when compared to a conventional Bismuth target, the material density of the $Bi_2O_3$ target is 30% less than the Bismuth target so the reduced efficiency was not unexpected. Increasing the density of the $Bi_2O_3$ target will result in higher production rates.

The results set forth above show:

- A scalable method of target deposition that is agnostic to substrate geometry.
- Targets deposited on different substrates (303SS, Al and Ti) remain robust when cycled 1× and 5× between RT and 600° C. in vacuum, or heated to 600, 650 or 800° C. in air on Ti and 303SS for 2 h or 5 h, with negligible mass loss.
- While Ti is a robust high temperature tolerant substrate, adhesion to the target can be optimized to reduce delamination caused by thermal cycling of processed films. Cohesive films lifted from the substrate surface in a few cases, while others remained adhered. Mechanical roughening of the substrate surface, interfacial oxide layer thickness and coefficient of thermal expansion match to the target, target mass, target area and thickness all play a role. Optimization of processing conditions will reduce delamination.
- The in-line heater configuration accommodated heating of the target up to 800° C. following $^6$Li beam irradiation.
- $Bi_2O_3$ targets were subjected to $^6$Li beam irradiation and sequential irradiation/heating trials with beam currents of 2.7 and 12 pnA respectively as well as exposing three targets to sequential irradiation/heating trials with beam currents of 2 pnA, 12 pnA and 19 pnA, respectively were successfully completed.
- $^{211}$Rn release was demonstrated from the $Bi_2O_3$ targets at temperatures >600° C. in a first test and from 570 to 700° C. in a second test with $^{211}$Rn release efficacy from the target determined to be between 60-80%.
- The target deposited on 303SS substrate remained robust in the low intensity beam line for two rapid heating/cooling cycles in high vacuum (1 e-6 torr).
- $Bi_2O_3$ target films deposited on Al disks exposed to Alpha beam irradiation at 90° incidence held up nicely in the beam line to produce 14 MBq·h of $^{211}$At when compared to 11 MBq·h for a Bismuth target, an estimated 30% improvement. Co-production of $^{18}$F was also noted from the $^{16}$O in the target.
- $Bi_2O_3$ targets (pellets glued to Al disks) were evaluating with alpha beams with a normal incidence (90°) beam geometry. The initial irradiation was conducted on a test target using 1 uA beam current for a total of 6 minutes. The target was removed and inspected after 5 minutes. Elimination of bubbles and cracking believed to be due to rapid exposure of the porous pellet to room atmosphere following irradiation under high vacuum can be obtained by optimizing processing conditions.

We claim:

1. A method of providing an alpha particle emitter for use in medical treatment comprising:

forming $Bi_2O_3$ powder into $Bi_2O_3$ targets comprising $Bi_2O_3$ pellets or $Bi_2O_3$ coatings on metal or metal oxide substrates, positioning the $Bi_2O_3$ targets in a heated vacuum chamber, subjecting the $Bi_2O_3$ targets to irradiation by a $^6$Li beam at an elevated temperature so as to generate $^{211}$Rn gas, collecting the $^{211}$Rn gas in an inert gas, and delivering the combination of the inert gas and $^{211}$Rn gas to a carrier for delivery to a treatment facility, the $^{211}$Rn gas generating $^{211}$At which in turn releases alpha particles effective for use in medical procedures.

2. The method of claim 1 wherein the metal or metal oxide substrates have a Coefficient of Thermal Expansion (CTE) the same as the Coefficient of Thermal Expansion (CTE) of the $Bi_2O_3$ coatings on the metal or metal oxide substrates.

3. The method of claim 1 wherein the metal or metal oxide substrates comprise aluminum silver, iron, stainless steel, titanium or alloys or oxides thereof.

4. The method of claim 1 wherein the $^6$Li beam has a beam current from 2 pnA to 19 pnA.

5. The method of claim 1 wherein the elevated temperature of the $Bi_2O_3$ targets is from 570 to 700° C.

6. The method of claim 1 wherein the elevated temperature causes release of 60 to 80% of the generated $^{211}Rn$ gas from the $Bi_2O_3$ targets.

7. The method of claim 1 wherein forming of the $Bi_2O_3$ powder into $Bi_2O_3$ targets comprising $Bi_2O_3$ pellets or $Bi_2O_3$ coatings comprises blending the $Bi_2O_3$ powder with a binder and distilled water.

8. The method of claim 7 wherein the binder is polyethylene glycol (PEG) 400 and/or PEG 3000 and/or methylcellulose.

9. The method of claim 1 wherein the $Bi_2O_3$ pellets are 13-16 mm in diameter and 1-2 mm thick.

10. The method of claim 7 wherein forming of the $Bi_2O_3$ coatings from $Bi_2O_3$ powder comprises blending the $Bi_2O_3$ powder with a methylcellulose binder and distilled water and forming films 28 μm to 32 μm thickness by doctor blading technique.

11. The method of claim 7 wherein the forming of the $Bi_2O_3$ coatings from $Bi_2O_3$ powder comprises blending the $Bi_2O_3$ powder with binders and distilled water to form a $Bi_2O_3$ solution and spin coating the $Bi_2O_3$ solution to form a multilayer film 28-32 μm in thickness comprising 4-layers, wherein, the multilayer film comprises an 8 μm first layer, a second layer having a thickness of 10 μm, a third layer having a thickness of 7 μm and a fourth layer adding 3 to 8 μm to provide a total film thickness of 28-32 μm.

12. The method of claim 7 wherein the $Bi_2O_3$ powder has particle sizes from 80 nm to 4 μm.

13. A method of providing alpha or Auger electron particle emitters for use in medical treatment comprising:

forming $M_xO_y$ or $M_xC_y$ targets comprising $M_xO_y$ or $M_xC_y$ pellets or $M_xO_y$ or $M_xC_y$ coatings on metal or metal oxide substrates, where M is selected from the group consisting of $^{209}Bi$, $^{75}As$ or $^{121}Sb$ positioning the $M_xO_y$ or $M_xC_y$ targets in a heated vacuum chamber, subjecting the $M_xO_y$ or $M_xC_y$ targets to irradiation by a $^{6}Li$ beam at an elevated temperature so as to generate a noble gas selected from the group consisting of $^{211}Rn$, $^{77}Kr$ or $^{123}Xe$, collecting the noble gas in an inert gas, and delivering the combination of the inert gas and noble gas to a carrier for delivery to a treatment facility, the noble gas generating a radiohalogen selected from the group consisting of $^{211}At$, $^{77}Br$ and $^{123}I$ which in turn releases-alpha particles or Auger electrons.

* * * * *